US010019946B2

(12) United States Patent
Choi

(10) Patent No.: US 10,019,946 B2
(45) Date of Patent: Jul. 10, 2018

(54) ORGANIC LIGHT EMITTING DIODE DISPLAY

(71) Applicant: Samsung Display Co., Ltd., Yongin-si, Gyeonggi-do (KR)

(72) Inventor: Jung Ho Choi, Seongnam-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 88 days.

(21) Appl. No.: 14/957,451

(22) Filed: Dec. 2, 2015

(65) Prior Publication Data

US 2016/0225318 A1 Aug. 4, 2016

(30) Foreign Application Priority Data

Feb. 2, 2015 (KR) ..... 10-2015-0016349

(51) Int. Cl.
*G09G 5/00* (2006.01)
*G09G 3/3258* (2016.01)

(52) U.S. Cl.
CPC ... *G09G 3/3258* (2013.01); *G09G 2300/0452* (2013.01); *G09G 2300/0819* (2013.01); *G09G 2310/0216* (2013.01); *G09G 2310/0262* (2013.01); *G09G 2320/0242* (2013.01); *G09G 2320/045* (2013.01)

(58) Field of Classification Search
CPC ..... G09G 3/3258; G09G 2300/0452; G09G 2300/0819; G09G 2310/0216; G09G 2310/0262; G09G 2320/045; G09G 2320/0242
See application file for complete search history.

(56) References Cited

U.S. PATENT DOCUMENTS

2005/0110727 A1* 5/2005 Shin ..... G09G 3/20 345/76
2006/0145964 A1* 7/2006 Park ..... G09G 3/3233 345/76

FOREIGN PATENT DOCUMENTS

KR 10-0635509 B1 10/2006
KR 10-2007-0080569 A 8/2007
KR 10-1160838 B1 7/2012
KR 10-2014-0053602 A 5/2014

* cited by examiner

*Primary Examiner* — Matthew Sim
(74) *Attorney, Agent, or Firm* — Lewis Roca Rothgerber Christie LLP

(57) ABSTRACT

An organic light emitting diode display includes: a plurality of pixels including a first pixel, a second pixel, and a third pixel connected to the plurality of scan lines and the plurality of data lines, wherein each pixel includes a switching transistor connected to a corresponding one of the scan lines and a corresponding one of the data lines, a driving transistor connected to the switching transistor, and an organic light emitting diode electrically connected to the driving transistor, and the driving range of the driving transistor of at least one pixel among the first pixel, the second pixel, and the third pixel is different from the driving range of the driving transistor of the remaining pixels.

9 Claims, 14 Drawing Sheets

ORGANIC LIGHT EMITTING DIODE DISPLAY

CROSS-REFERENCE TO RELATED APPLICATION

This application claims priority to and the benefit of Korean Patent Application No. 10-2015-0016349 filed in the Korean Intellectual Property Office on Feb. 2, 2015, the entire contents of which are incorporated herein by reference.

BACKGROUND

1. Field

The present disclosure is related to an organic light emitting diode display.

2. Description of the Related Art

An organic light emitting diode display includes two electrodes and an organic light emitting layer positioned therebetween. Electrons injected from a cathode electrode and holes injected from an anode electrode are combined with each other in the organic light emitting layer to form excitons. Light is emitted while the excitons discharge energy.

The organic light emitting diode display includes a plurality of pixels each including an organic light emitting diode formed of the cathode, the anode, and the organic light emitting layer. A plurality of thin film transistors and at least one capacitor for driving the organic light emitting diode are formed in each pixel. The plurality of thin film transistors includes a switching thin film transistor and a driving thin film transistor.

The driving transistor controls a driving current to the organic light emitting diode, and all driving transistors of the plurality of pixels should have the same current magnitude in response to the same applied voltage, thereby having the same driving range.

However, emission efficiency varies depending on a kind of the organic emission layer used in a plurality of pixels such that a current-luminance ratio, where luminance depends on the current flow in each pixel, is different. That is, the current-luminance of the red pixel and the green pixel is higher in comparison to the blue pixel such that the luminance for the same current is brighter. That is, the red pixel and the green pixel are more sensitive to the luminance depending on the current, in comparison to the blue pixel.

In this case, a variation is easily generated in the driving range of the driving transistors by a distribution on the manufacturing process, and in this case, a color variation is easily generated in the red pixel or the green pixel having the sensitive luminance depending on the current, and particularly, the color variation may be recognized at a low gray level.

The above information disclosed in this Background section is only for enhancement of understanding of the background of the disclosure and therefore it may contain information that does not form prior art.

SUMMARY

The present disclosure provides an organic light emitting diode display for improving the color variation at a low gray level.

According to an aspect of an embodiment of the present invention, an organic light emitting diode display may include: a substrate; a plurality of scan lines on the substrate and configured to transmit a scan signal; a plurality of data lines and a plurality of driving voltage lines crossing the scan lines and configured to transmit a data voltage and a driving voltage, respectively; and a plurality of pixels comprising a first pixel, a second pixel, and a third pixel, and connected to the plurality of scan lines and the plurality of data lines, wherein each of the pixels includes: a switching transistor connected to a corresponding one of the scan lines and a corresponding one of the data lines; a driving transistor connected to the switching transistor; an organic light emitting diode connected to the driving transistor; and a driving range of the driving transistor of at least one of the first pixel, the second pixel, and the third pixel, is different from the driving range of the driving transistor of at least another one of the first pixel, the second pixel, and the third pixel.

The driving range of each driving transistor of the first pixel, the second pixel, and the third pixel may be different.

The driving range of the driving transistor may be a difference between a maximum driving gate-source voltage of the driving transistor corresponding to a maximum gray level and a minimum driving gate-source voltage of the driving transistor corresponding to a minimum gray level, and the driving range of the driving transistor may increase as a current-luminance ratio of a corresponding pixel from among the first pixel, the second pixel, and the third pixel, is increased.

The first pixel, the second pixel, and the third pixel may be a red pixel, a green pixel, and a blue pixel, respectively, and the current-luminance ratio of the green pixel may be greater than the current-luminance ratio of the red pixel, the current-luminance ratio of the red pixel may be greater than the current-luminance ratio of the blue pixel, the driving range of the driving transistor of the green pixel may be greater than the driving range of the driving transistor of the red pixel, and the driving range of the driving transistor of the red pixel may be greater than the driving range of the driving transistor of the blue pixel.

The driving transistor may include: a driving channel on the substrate, a driving gate electrode overlapping the driving channel, and a driving source electrode and a driving drain electrode at respective sides of the driving channel.

A width of the driving channel of the green pixel may be less than a width of the driving channel of the red pixel, and the width of the driving channel of the red pixel may be less than a width of the driving channel of the blue pixel.

The length of the driving channel of the green pixel may be larger than the length of the driving channel of the red pixel, and the length of the driving channel of the red pixel may be smaller than the length of the driving channel of the blue pixel.

The organic light emitting diode display may further include: a first gate insulating layer between the driving channel and the driving gate electrode; and a thickness of the first gate insulating layer of the green pixel may be greater than a thickness of the first gate insulating layer of the red pixel, and the thickness of the first gate insulating layer of the red pixel may be greater than a thickness of the first gate insulating layer of the blue pixel.

The channel doping degree of the driving channel of the green pixel may be less than a channel doping degree of the driving channel of the red pixel, and the channel doping degree of the driving channel of the red pixel may be less than a channel doping degree of the driving channel of the blue pixel.

The driving ranges of two driving transistors from among the first pixel, the second pixel, and the third pixel, are the same, and are different from the driving range of the driving transistor of at least another one of the first pixel, the second pixel, and the third pixel.

The driving range of one driving transistor from among the first pixel, the second pixel, and the third pixel, may be different from the driving range of the driving transistors of at least another one of the first pixel, the second pixel, and the third pixel.

The organic light emitting diode may include: a pixel electrode electrically connected to the driving transistor; an organic emission layer on the pixel electrode; and a common electrode on the organic emission layer.

According to the present disclosure, the driving range of at least one driving transistor among the red pixel, the green pixel, and the blue pixel is different from the driving range of the remaining driving transistors, thereby improving the color variation at the low gray level.

That is, by increasing the driving range of the driving transistor as the current-luminance ratio is increased among the red pixel, the green pixel, and the blue pixel, the color variation may be reduced or minimized in the pixel in which the luminance depending on the current is sensitive, thereby improving the color variation that is significant at the low gray level.

DETAILED DESCRIPTION

Figure 1:
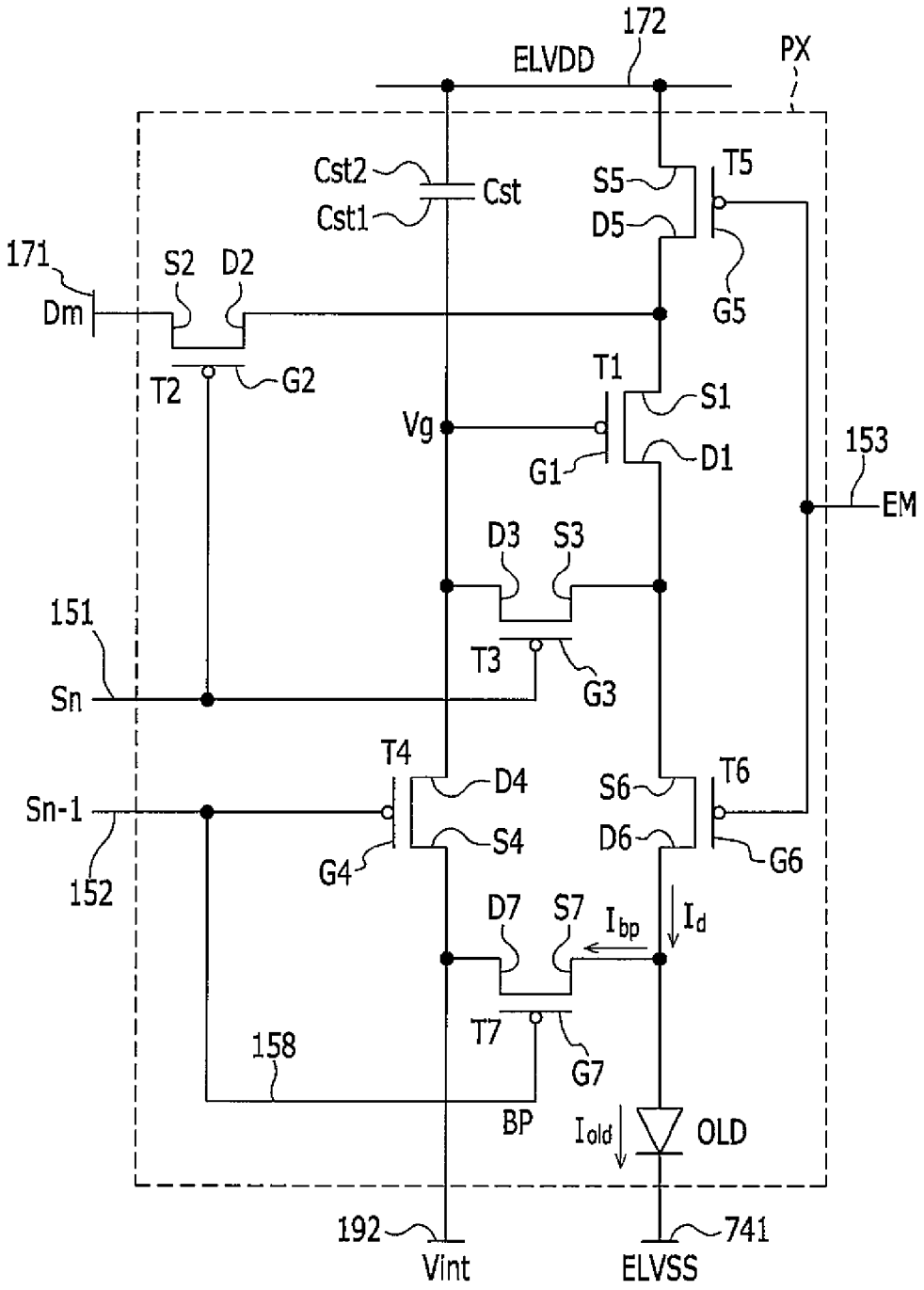
FIG. 1 is an equivalent circuit diagram of a pixel connected to a plurality of signal lines of an organic light emitting diode display according to an exemplary embodiment of the present disclosure.

The present disclosure will be described more fully hereinafter with reference to the accompanying drawings, in which exemplary embodiments of the present disclosure are shown. As those skilled in the art would realize, the described embodiments may be modified in various different ways, all without departing from the spirit or scope of the present disclosure.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and components and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or the like. Further, the various components of these devices may be a process or thread, running on one or more processors, in one or more computing devices, executing computer program instructions and interacting with other system components for performing the various functionalities described herein. The computer program instructions may be stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of ordinary skill in the art should recognize that the functionality of various computing devices may be combined or integrated into a single computing device, or the functionality of a particular computing device may be distributed across one or more other computing devices without departing from the spirit and scope of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Further, in the specification, the word "in a plan view" means when an object portion is viewed from above, and the word "in a cross-section" means when a cross-section taken by vertically cutting an object portion is viewed from the side.

In the accompanying drawings, an active matrix (AM) type of organic light emitting diode (OLD) display is illustrated to have a 7Tr-1 Cap structure in which seven transistors (TFTs) and one capacitor are provided for one pixel, but the present disclosure is not limited thereto. Thus, in the organic light emitting diode display, each pixel may be provided with a plurality of transistors and at least one capacitor, and may be formed to have various structures by further forming additional wires and/or omitting existing wires. In this case, the pixel is a minimum unit (or a smallest unit) for displaying an image, and the organic light emitting diode display displays the image through the plurality of pixels. However, the present invention is not limited thereto.

The organic light emitting diode display according to an exemplary embodiment of the present disclosure will be described with reference to accompanying drawings.

FIG. 1 is an equivalent circuit diagram of a pixel connected to a plurality of signal lines of an organic light emitting diode display according to an exemplary embodiment of the present disclosure.

As shown in FIG. 1, the organic light emitting diode display according to an exemplary embodiment of the present disclosure includes a plurality of signal lines 151, 152, 153, 158, 171, 172, and 192 and a plurality of pixels PX arranged in a matrix and connected to the plurality of signal lines.

One pixel PX includes a plurality of transistors T1, T2, T3, T4, T5, T6, and T7, a storage capacitor Cst, and an organic light emitting diode OLD that are connected to the plurality of signal lines 151, 152, 153, 158, 171, 172, and 192.

The transistors T1, T2, T3, T4, T5, T6, and T7 include a driving transistor T1, a switching transistor T2, a compensation transistor T3, an initialization transistor T4, an operation control transistor T5, a light emission control transistor T6, and a bypass transistor T7.

The signal lines 151, 152, 153, 158, 171, 172, and 192 include a scan line 151 for transferring a scan signal Sn, a previous scan line 152 for transferring a previous scan signal Sn−1 to the initialization transistor T4, a light emission control line 153 for transferring a light emission control signal EM to the operation control transistor T5 and the light emission control transistor T6, a bypass control line 158 for transferring a bypass signal BP to the bypass transistor T7, a data line 171 crossing the scan line 151 for transferring a data signal Dm, a driving voltage line 172 for transferring a driving voltage ELVDD and formed to be substantially parallel with the data line 171, and an initialization voltage line 192 for transferring an initialization voltage Vint for initializing the driving transistor T1.

A gate electrode G1 of the driving transistor T1 is connected with one end Cst1 of the storage capacitor Cst, a source electrode S1 of the driving transistor T1 is connected with the driving voltage line 172 via the operation control transistor T5, and a drain electrode D1 of the driving transistor T1 is electrically connected with an anode of the organic light emitting diode OLD via the light emission control transistor T6. The driving transistor T1 receives the data signal Dm according to a switching operation of the switching transistor T2 to supply a driving current Id to the organic light emitting diode OLD.

A gate electrode G2 of the switching transistor T2 is connected with the scan line 151, a source electrode S2 of the switching transistor T2 is connected with the data line 171, and a drain electrode D2 of the switching transistor T2 is connected with the source electrode S1 of the driving transistor T1 and with the driving voltage line 172 via the operation control transistor T5. The switching transistor T2 is turned on according to the scan signal Sn received through the scan line 151 to perform a switching operation for transferring the data signal Dm transferred to the data line 171 to the source electrode S1 of the driving transistor T1.

A gate electrode G3 of the compensation transistor T3 is directly connected with the scan line 151, a source electrode S3 of the compensation transistor T3 is connected to the drain electrode D1 of the driving transistor T1 and with an anode of the organic light emitting diode OLD via the light emission control transistor T6, and a drain electrode D3 of the compensation transistor T3 is connected with one end Cst1 of the storage capacitor Cst, the drain electrode D4 of the initialization transistor T4, and the gate electrode G1 of the driving transistor T1, together. The compensation transistor T3 is turned on according to the scan signal Sn received through the scan line 151 to connect the gate electrode G1 and the drain electrode D1 of the driving transistor T1 and diode-connect the driving transistor T1.

A gate electrode G4 of the initialization transistor T4 is connected with the previous scan line 152, a source electrode S4 of the initialization transistor T4 is connected with the initialization voltage line 192, and a drain electrode D4 of the initialization transistor T4 is connected with one end Cst1 of the storage capacitor Cst and the gate electrode G1 of the driving transistor T1 together through the drain electrode D3 of the compensation transistor T3. The initialization transistor T4 is turned on according to a previous scan signal Sn−1 received through the previous scan line 152 to transfer the initialization voltage Vint to the gate electrode G1 of the driving transistor T1 and then perform an initialization operation of initializing a voltage of the gate electrode G1 of the driving transistor T1.

A gate electrode G5 of the operation control transistor T5 is connected with the light emission control line 153, a source'electrode S5 of the operation control transistor T5 is connected with the driving voltage line 172, and a drain electrode D5 of the operation control transistor T5 is connected with the source electrode S1 of the driving transistor T1 and the drain electrode S2 of the switching transistor T2.

A gate electrode G6 of the light emission control transistor T6 is connected to the light emission control line 153, the source electrode S6 of the first light emission control transistor T6 is connected to the drain electrode D1 of the driving transistor T1 and the source electrode S3 of the compensation transistor T3, and the drain electrode D6 of the first light emission control transistor T6 is electrically connected to the anode of the organic light emitting diode OLD. The operation control transistor T5 and the first light emission control transistor T6 are concurrently (e.g., simultaneously) turned on according to the light emission control signal EM transmitted to the light emission control line 153 such that the driving voltage ELVDD is supplied through the diode-connected driving transistor T1 and is transmitted to the organic light emitting diode OLD.

A gate electrode G7 of the thin film bypass transistor T7 is connected to the bypass control line 158, a source electrode S7 of the bypass thin film transistor T7 is connected to the drain electrode D6 of the light emission control thin film transistor T6 and the anode of the organic light emitting diode OLD together, and a drain electrode D7 of the bypass thin film transistor T7 is connected to the initialization voltage line 192 and the source electrode S4 of the initialization thin film transistor T4 together. Here, the bypass control line 158 is connected to the previous scan line 152 such that the bypass signal BP is the same as the previous scan signal Sn−1.

The other end Cst2 of the storage capacitor Cst is connected with the driving voltage line 172, and a cathode of the organic light emitting diode OLD is connected with a common voltage line 741 for transferring a common voltage ELVSS.

A 7-transistor and 1-capacitor structure including the bypass transistor T7 is described in an exemplary embodiment of the present disclosure, however the present disclosure is not limited thereto, and a number of transistors and a number of capacitors may be variously changed.

Hereinafter, a detailed operation process of one pixel of the organic light emitting diode display according to the exemplary embodiment of the present disclosure will be described in more detail with reference to FIG. 2.

Figure 2:
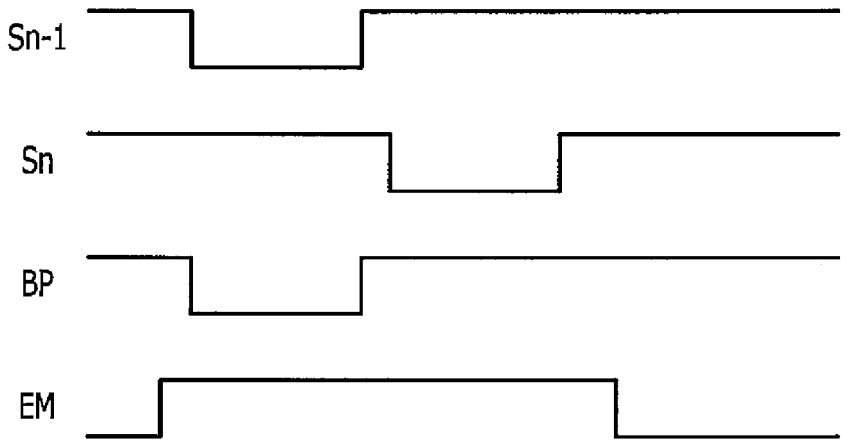
FIG. 2 is a timing diagram of signals applied to one pixel of an organic light emitting diode display according to an exemplary embodiment of the present disclosure.

FIG. 2 is a timing diagram of signals applied to one pixel of an organic light emitting diode display according to an exemplary embodiment of the present disclosure.

As shown in FIG. 2, first, for an initializing period, the previous scan signal Sn−1 having a low level is supplied through the previous scan line 152. Then, the initializing thin film transistor T4 is turned on in response to the previous scan signal Sn−1 having the low level, the initial voltage Vint is connected to the gate electrode G1 of the driving transistor T1 from the initialization voltage line 178 through the initializing thin film transistor T4, and the driving thin film transistor T1 is initialized by the initialization voltage Vint.

Thereafter, for a data programming period, the scan signal Sn having a low level is supplied through the scan line 151. Then, the switching thin film transistor T2 and the compensating thin film transistor T3 are turned on in response to the scan signal Sn having the low level. At this time, the driving transistor T1 is diode-connected through the turned-on compensation transistor T3 and is forward biased.

A compensation voltage Dm+Vth (where Vth is a negative (−) value) reduced by a threshold voltage Vth of the driving thin film transistor T1 from a data signal Dm supplied from the data line 171 is applied to the gate electrode G1 of the driving thin film transistor T1. That is, the gate voltage Vg applied to the gate electrode G1 of the driving transistor T1 becomes the compensation voltage (Dm+Vth).

The driving voltage ELVDD and the compensation voltage (Dm+Vth) are applied to respective terminals of the storage capacitor Cst, and a charge corresponding to a voltage difference between the terminals is stored in the storage capacitor Cst.

Next, during the light emission period, the light emission control signal EM supplied from the light emission control line 153 is changed from the high level to the low level. Thus, the operation control transistor T5 and the light emission control transistor T6 are turned on by the light emission control signal EM of the low level during the light emission period.

Thus, a driving current Id is generated according to the voltage difference between the gate voltage of the gate electrode G1 of the driving transistor T1 and the driving voltage ELVDD, and the driving current Id is supplied to the organic light emitting diode OLD through the light emission control transistor T6. The gate-source voltage Vgs of the driving thin film transistor T1 is maintained as (Dm+Vth)−ELVDD by the storage capacitor Cst for the light emission period. According to a current-voltage relationship of the driving thin film transistor T1, the driving current Id is proportional to the square $(Dm-ELVDD)^2$ of a value obtained by subtracting the threshold voltage from the source-gate voltage. Accordingly, the driving current Id is determined regardless of the threshold voltage Vth of the driving thin film transistor T1.

In this case, the bypass transistor T7 is transmitted with the bypass signal BP from the bypass control line 158 and the portion of the driving current Id is discharged as the bypass current Ibp through the bypass transistor T7.

When a minimum current of the driving transistor T1 for displaying the black image flows as the driving current, if the organic light emitting diode (OLD) is also emitted, the black image is not normally displayed. Accordingly, the bypass transistor T7 of the organic light emitting diode display according to an exemplary embodiment of the present disclosure may disperse the portion of the minimum (or the smallest) current of the driving transistor T1 as the bypass current Ibp through the current path adjacent the current path of the organic light emitting diode. Here, the minimum (or the smallest) current of the driving transistor T1 means the current of the driving transistor T1 such that the driving transistor T1 is turned off since the gate-source voltage Vgs of the driving transistor T1 is less than the threshold voltage Vth. The minimum (or the smallest) driving current (for example, a current of 10 pA or less) in which the driving transistor T1 is turned off is transferred to the organic light emitting diode OLD to emit light such that the organic light emitting diode OLD is expressed as an image with black luminance. When the minimum (or the smallest) driving current for expressing the black image flows, an influence on a bypass transfer of the bypass current Ibp is large, but when a large driving current for expressing an image, such as a normal image or a white image, flows, there may be little influence in the bypass current Ibp. Accordingly, when the driving current for displaying the black image flows, the light emission current Iold of the organic light emitting diode OLD which is reduced by the current amount of the bypass current Ibp which flows out from the driving current Id through the bypass transistor T7, has a minimum (or smallest) current amount as a level which may be equivalent to exactly the current amount for expressing the black image. Therefore, a black luminance image is exactly implemented by using the bypass transistor T7, thereby improving a contrast ratio. In FIG. 2, the bypass signal BP is the same or substantially the same as a previous scan signal Sn−1, but is not necessarily limited thereto.

Next, a structure of a plurality of pixels of the organic light emitting diode display shown in FIG. 1 and FIG. 2 will be described in detail with reference to FIG. 3.

Figure 3:
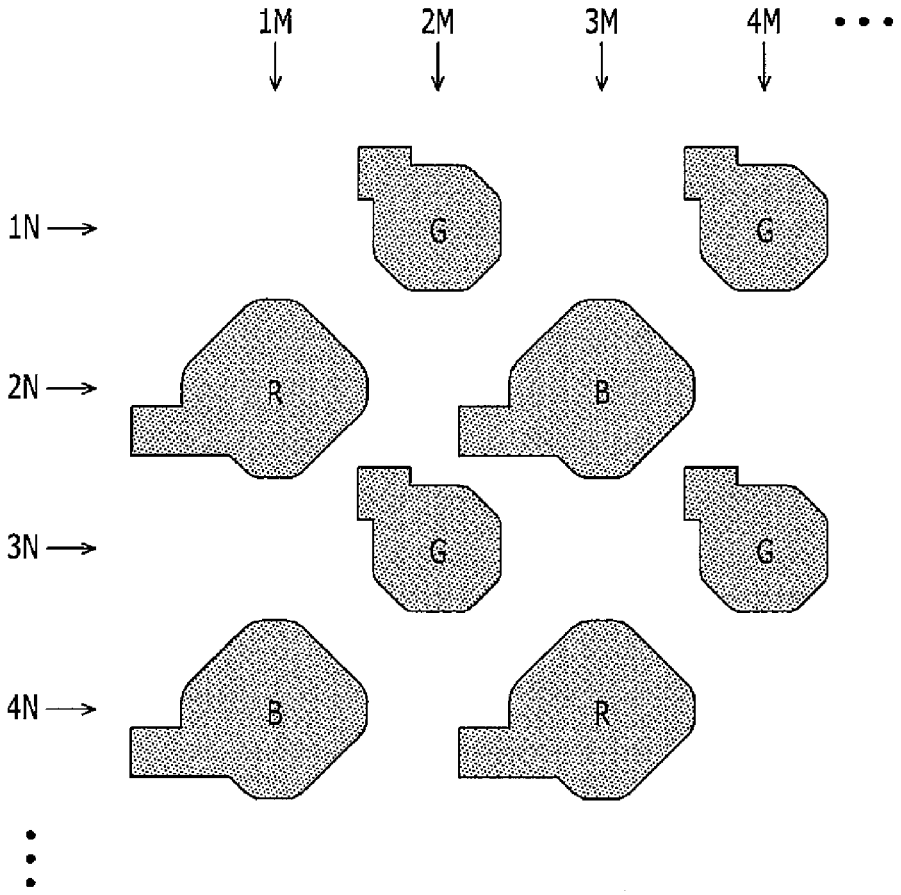
FIG. 3 is a schematic layout view of a plurality of pixels of an organic light emitting diode display according to an exemplary embodiment of the present disclosure.

FIG. 3 is a schematic layout view of a plurality of pixel of an organic light emitting diode display according to an exemplary embodiment of the present disclosure.

As shown in FIG. 3, a plurality of green pixels G corresponding to a second pixel are separated (e.g., separated by a predetermined or set interval) in a first row 1N, a plurality of red pixels R corresponding to a first pixel and a blue pixel B corresponding to a third pixel are alternately arranged in a second row 2N adjacent thereto, a plurality of green pixels G are separated (e.g., separated by a predetermined or set interval) in a third row 3N adjacent thereto, a plurality of blue pixels B and red pixels R are alternately arranged in a fourth row 4N adjacent thereto, and the pixel arrangement is repeated to an N-th row. In this case, the blue pixel B and the red pixel R are formed to be larger than the green pixel G.

In this case, the plurality of green pixels G arranged in the first row 1N and the plurality of red pixels R and blue pixels B arranged in the second row 2N are alternately arranged. Accordingly, the red pixel R and the blue pixel B are alternately arranged in a first column 1M, the plurality of green pixels G is spaced apart from each other (e.g., spaced by a predetermined or set interval) in an adjacent second column 2M, the blue pixel B and the red pixel R are alternately arranged in an adjacent third column 3M, and the plurality of green pixels G are arranged to be spaced apart from each other (e.g., spaced by a predetermined or set interval) in an adjacent fourth column 4M, and the arrangement of the pixels is repeated up to an M-th column.

The aforementioned pixel arrangement or structure is referred to as a pentilel matrix, and high definition with a small number of pixels may be implemented by adopting, rendering, driving, and/or sharing adjacent pixels to express colors.

A detailed structure of the organic light emitting diode display according to the pixel arrangement illustrated in FIG. 3 will be described in detail with reference to FIG. 4, FIG. 5, FIG. 6, FIG. 7, and FIG. 8.

Figure 4:
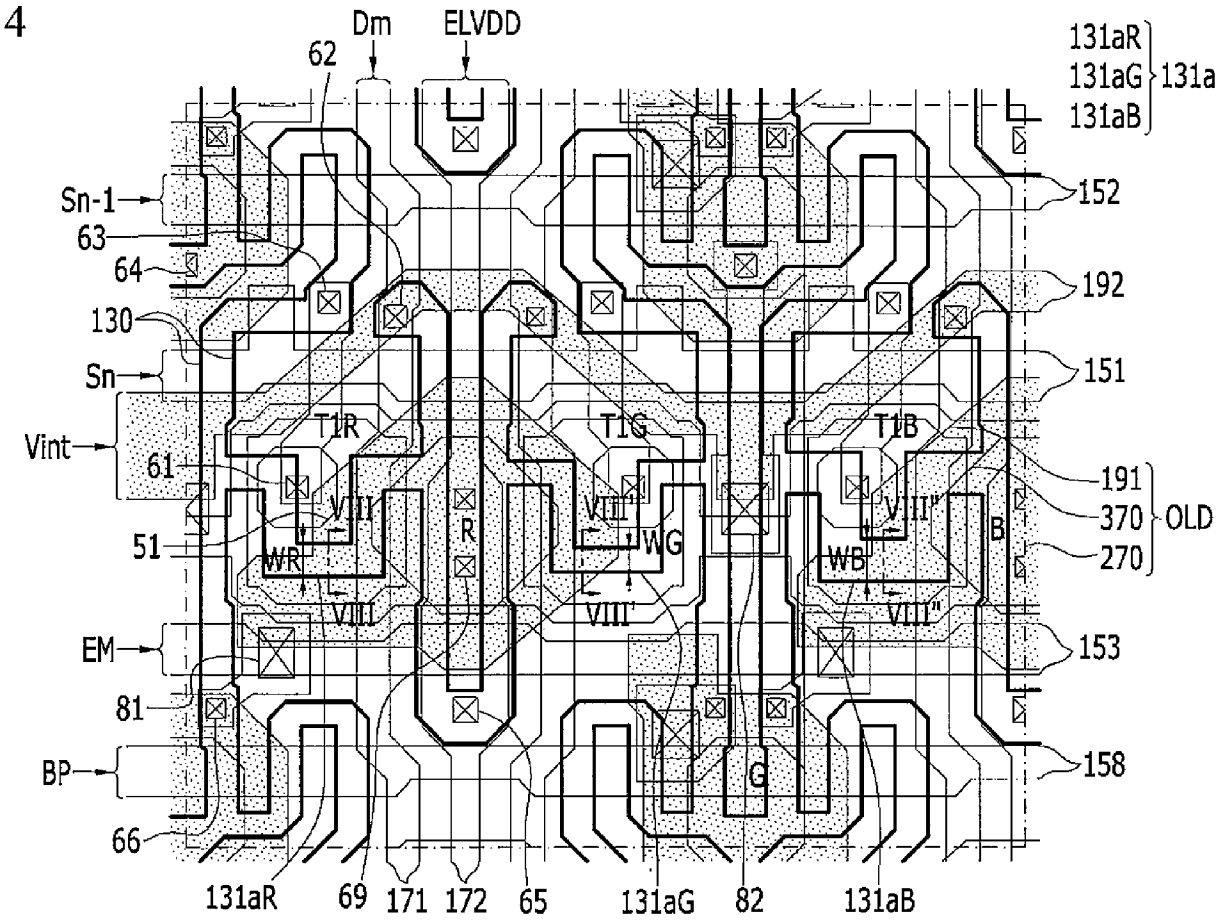
FIG. 4 is a schematic layout view of a transistor and a capacitor forming a red pixel, a green pixel, and a blue pixel of an organic light emitting diode display according to an exemplary embodiment of the present disclosure.
Figure 5:
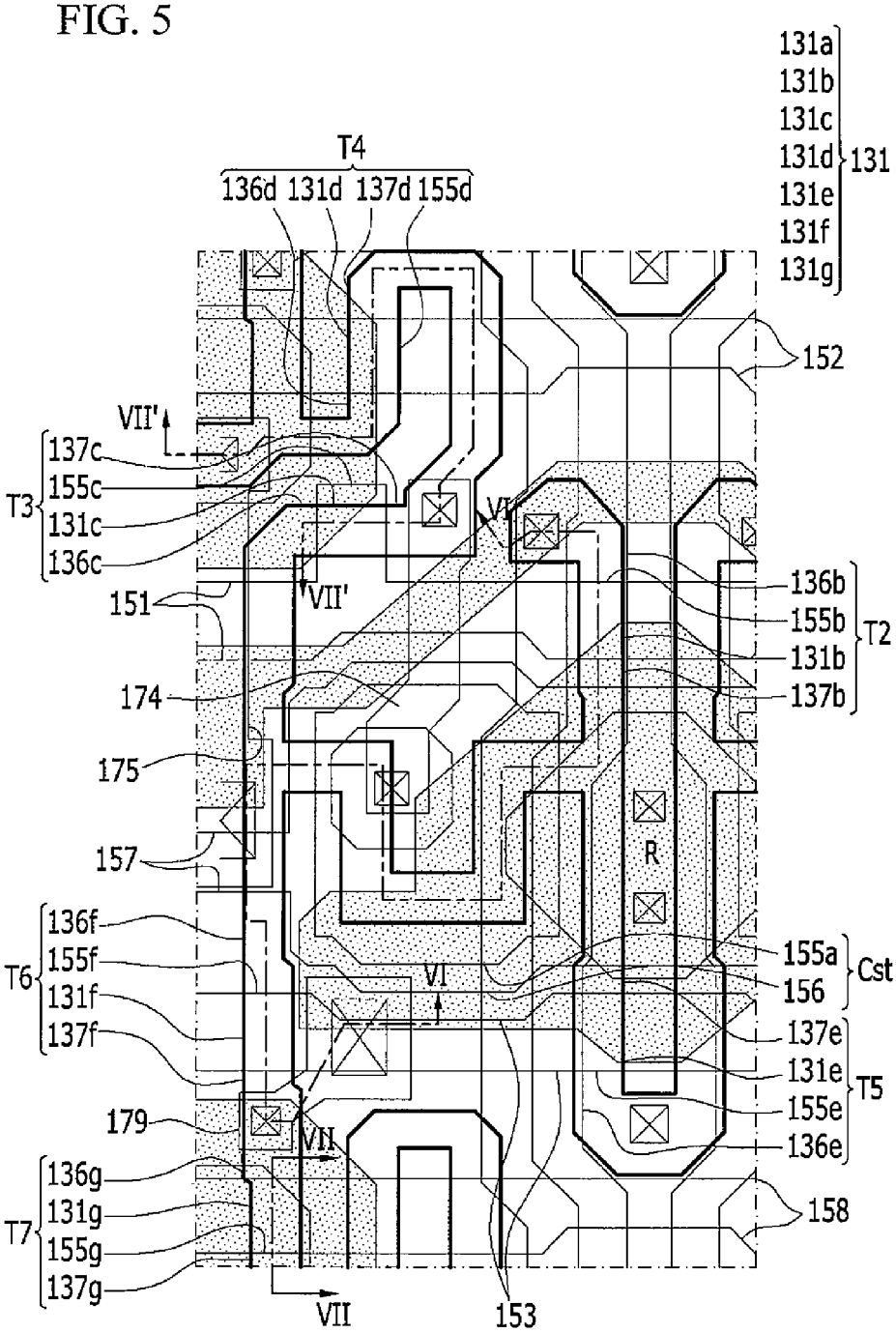
FIG. 5 is a detailed layout view of one pixel of FIG. 4.
Figure 6:
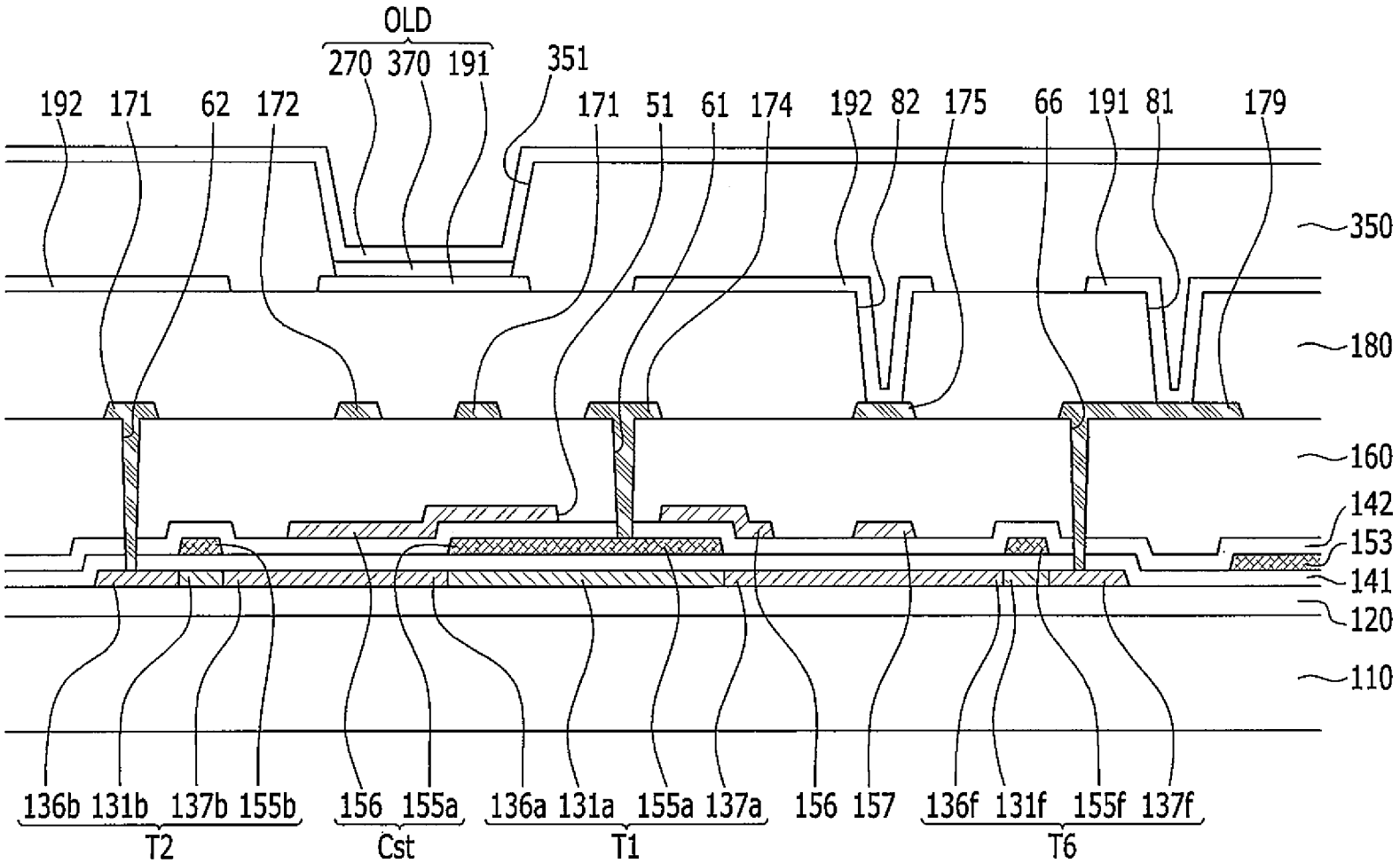
FIG. 6 is a cross-sectional view of the organic light emitting diode display of FIG. 5 taken along the line VI-VI.
Figure 7:
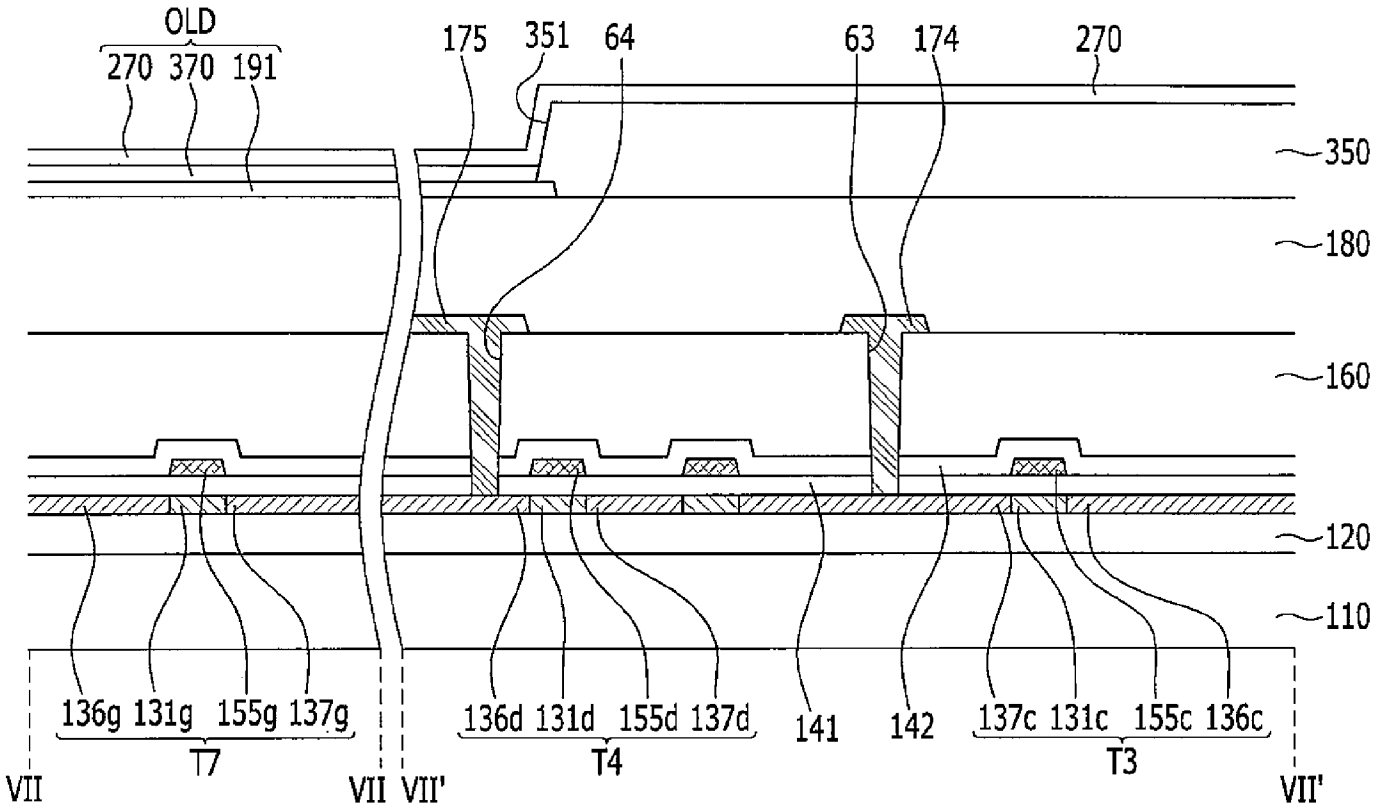
FIG. 7 is a cross-sectional view of the organic light emitting diode display of FIG. 5 taken along the lines VII-VII and VII'-VII'.
Figure 8:
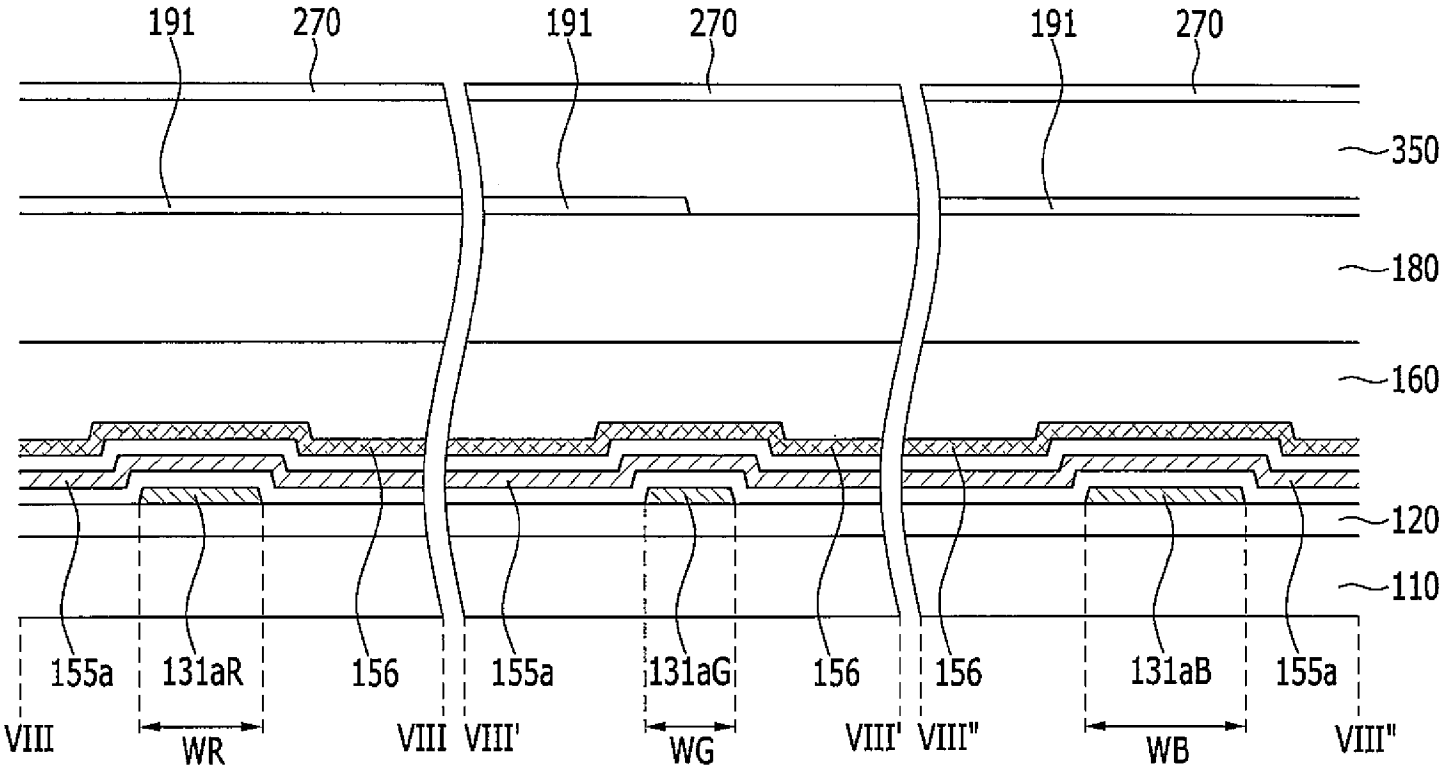
FIG. 8 is a cross-sectional view of the organic light emitting diode display of FIG. 4 taken along the lines VIII-VIII, VIII'-VIII', and VIII"-VIII".

FIG. 4 is a schematic layout view of a transistor and a capacitor forming a red pixel, a green pixel, and a blue pixel of an organic light emitting diode display according to an exemplary embodiment of the present disclosure, FIG. 5 is a detailed layout view of one pixel of FIG. 4, FIG. 6 is a cross-sectional view of the organic light emitting diode display of FIG. 5 taken along the line VI-VI, FIG. 7 is a cross-sectional view of the organic light emitting diode display of FIG. 5 taken along the lines VII-VII and VII'-VII', and FIG. 8 is a cross-sectional view of the organic light emitting diode display of FIG. 4 taken along the lines VIII-VIII, VIII'-VIII', and VIII"-VIII".

Hereinafter, a detailed planar structure of the organic light emitting diode display according to the exemplary embodiment of the present disclosure will be described in more detail with reference to FIG. 4 and FIG. 5, and a detailed cross-sectional structure will be described in more detail with reference to FIG. 6 to FIG. 8.

First, as shown in FIG. 4 and FIG. 5, an organic light emitting diode display according to an exemplary embodiment of the present disclosure includes a scan line 151, a previous scan line 152, an emission control line 153, and a bypass control line 158 respectively transmitting a scan signal Sn, a previous scan signal Sn−1, an emission control signal EM, and a bypass signal BP and formed along a row direction. A data line 171 and a driving voltage line 172 crossing the scan line 151, the previous scan line 152, the emission control line 153, and the bypass control line 158 are also included, and a data signal Dm and a driving voltage ELVDD are respectively applied to the pixel PX. The initialization voltage Vint is transmitted from the initialization voltage line 192 through the initialization transistor T4 to the compensation transistor T3. The initialization voltage line 192 is formed while alternately having a straight portion and an oblique portion.

Further, a driving thin film transistor T1, a switching thin film transistor T2, a compensation thin film transistor T3, an initialization thin film transistor T4, an operation control thin film transistor T5, an emission control thin film transistor T6, a bypass thin film transistor T7, a storage capacitor Cst, and an organic light emitting diode OLD are formed in the pixel PX. The pixel PX shown in FIG. 4 and FIG. 5 may correspond to a red pixel R, a green pixel G, and a blue pixel B forming a pentile matrix structure.

The organic light emitting diode (OLD) is made of a pixel electrode 191, an organic emission layer 370, and a common electrode 270. In this case, the compensation transistor T3 and the initialization transistor T4 are configured as a dual gate structure transistor in order to block a leakage current.

Channels of the driving transistor T1, the switching transistor T2, the compensation transistor T3, the initialization transistor T4, the operation control transistor T5, the light emission control transistor T6, and the bypass transistor T7 are formed in one semiconductor 130 connected thereto, and the semiconductor 130 may be formed to be curved in various shapes. The semiconductor 130 may be made of a polycrystalline semiconductor material and/or an oxide semiconductor material. The oxide semiconductor material may include any one oxide based on titanium (Ti), hafnium (Hf), zirconium (Zr), aluminum (Al), tantalum (Ta), germanium (Ge), zinc (Zn), gallium (Ga), tin (Sn), or indium (In), and indium-gallium-zinc oxide (InGaZnO4), indium-zinc oxide (Zn—In—O), zinc tin oxide (Zn—Sn—O), indium-gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium-gallium oxide (In—Ge—Ga—O), titanium-indium-zinc oxide (Ti—In—Zn—O), or hafnium-indium-zinc oxide (Hf—In—Zn—O) which is a compound oxide thereof. In the case where the semiconductor 130 is made of the oxide semiconductor material, a separate passivation layer for protecting the oxide semiconductor material which is vulnerable to an external environment such as a high temperature, may be added.

The semiconductor 130 includes a channel 131 which is doped with an N-type impurity or a P-type impurity, and a source doping part and a drain doping part which are formed at corresponding sides of the channel and doped with a doping impurity that is an opposite-type to the doping impurity doped on the channel. In the exemplary embodiment, the source doping part and the drain doping part correspond to the source electrode and the drain electrode, respectively. The source electrode and the drain electrode formed in the semiconductor 130 may be formed by doping only the corresponding regions. Further, in the semiconductor 130, a region between the source electrodes and the drain electrodes of different transistors is doped and thus the source electrode and the drain electrode may be electrically connected to each other.

As illustrated in FIG. 5, the channel 131 includes a driving channel 131*a* formed in the drive transistor T1, a switching channel 131*b* formed in the switching transistor T2, a compensation channel 131*c* formed in the compensation transistor T3, an initialization channel 131*d* formed in the initialization transistor T4, an operation control channel 131*e* formed in the operation control transistor T5, a light emission control channel 131*f* formed in the light emission control transistor T6, and a bypass channel 131*g* formed in the bypass transistor T7.

The driving transistor T1 includes the driving channel 131*a*, a driving gate electrode 155*a*, a driving source electrode 136*a*, and a driving drain electrode 137*a*. The driving channel 131*a* is curved and may have a meandering shape or a zigzag shape. As such, by forming the curved driving channel 131*a*, the driving channel 131*a* may be formed to be elongated in a narrow space. Accordingly, a driving range of the gate voltage applied to the driving gate electrode 155*a* is increased by the elongated driving channel 131*a*.

The driving range of the driving gate-source voltage Vgs means a difference between a maximum (or largest) driving gate-source voltage of the driving transistor corresponding to the maximum (or largest) gray and a minimum (or smallest) driving gate-source voltage of the driving transistor corresponding to the minimum (or smallest) gray level or the difference between the driving gate-source voltage Vgs for each step for expressing of the gray level, since the driving range of the driving gate-source voltage Vgs is increased, a gray scale of light emitted from the organic light emitting diode OLD may be finely controlled by changing the magnitude of the driving gate-source voltage Vgs, and as a result, the resolution of the organic light emitting diode display device may be enhanced and display quality may be improved. Various example shapes such as 'reverse S', 'S', 'M', and 'W' may be implemented by variously modifying the shape of the driving channel 131*a*.

The driving gate electrode 155*a* overlaps with the driving channel 131*a*, and the driving source electrode 136*a* and the driving drain electrode 137*a* are formed at respective sides of the driving channel 131*a* to be close to each other. The driving gate electrode 155*a* is connected to a first data connecting member 174 through a contact hole 61.

The switching transistor T2 includes the switching channel 131*b*, a switching gate electrode 155*b*, a switching source electrode 136*b*, and a switching drain electrode 137*b*. The switching gate electrode 155*b* which is a part that extends downward from the scan line 121 overlaps with the switching channel 131*b*, and the switching source electrode 136*b* and the switching drain electrode 137*b* are formed at respective sides of the switching channel 131*b* to be close to each other. The switching source electrode 136*b* is connected with the data line 171 through a contact hole 62.

The compensation transistor T3 includes the compensation channel 131*c*, a compensation gate electrode 155*c*, a compensation source electrode 136*c*, and a compensation drain electrode 137*c*. The compensation gate electrode 155*c* which is a part of the scan line 151 is formed as two electrodes to prevent a leakage current and overlaps the compensation channel 131*c*. The compensation source electrode 136*c* and the compensation drain electrode 137*c* are formed to be adjacent to respective sides of the compensation channel 131*c*. The compensation drain electrode 137*c* is connected to the first data connecting member 174 through a contact hole 63.

The initialization transistor T4 includes the initialization channel 131*d*, an initialization gate electrode 155*d*, an initialization source electrode 136*d*, and an initialization drain electrode 137*d*. The initialization gate electrode 155*d* which is a part of the previous scan line 152 is formed as two electrodes to prevent the leakage current and overlaps the initialization channel 131*d*. The initialization source electrode 136*d* and the initialization drain electrode 137*d* are formed to be adjacent to respective sides of the initialization channel 131*d*. The initialization source electrode 136*d* is connected to a second data connecting member 175 through a contact hole 64.

The operation control transistor T5 includes the operation control channel 131*e*, an operation control gate electrode 155*e*, an operation control source electrode 136*e*, and an operation control drain electrode 137*e*. The operation control gate electrode 155*e* which is a part of the light emission control line 153 overlaps the operation control channel 131*e*, and the operation control source electrode 136*e* and the operation control drain electrode 137*e* are formed to be adjacent to respective sides of the operation control channel 131*e*. The operation control source electrode 136*e* is connected to a part that extends from the driving voltage line 172 through a contact hole 65.

The light emission control transistor T6 includes the light emission control channel 131*f*, a light emission control gate electrode 155*f*, a light emission control source electrode 136*f*, and a light emission control drain electrode 137*f*. The light emission control gate electrode 155*f* which is a part of the light emission control line 153 overlaps the light emission control channel 131*f*, and the light emission control source electrode 136*f* and the light emission control drain electrode 137*f* are formed to be adjacent to respective sides of the light emission control channel 131*f*. The light emission control drain electrode 137*f* is connected to a third data connecting member 179 through a contact hole 66.

The bypass transistor T7 includes the bypass channel 131*g*, a bypass gate electrode 155*g*, a bypass source electrode 136*g*, and a bypass drain electrode 137*g*. The bypass gate electrode 155*g* which is a part of the bypass control line 158 overlaps the bypass channel 131*g*, and the bypass source electrode 136*g* and the bypass drain electrode 137*g* are formed to be adjacent to respective sides of the bypass channel 131*g*.

The bypass source electrode 136*g* is connected directly to the light emission control drain electrode 137*f*, and the bypass drain electrode 137*g* is connected directly to the initialization source electrode 136*d*.

One end of the driving channel 131*a* of the driving transistor T1 is connected to the switching drain electrode 137*b* and the operation control drain electrode 137*e*, and the other end of the driving channel 131*a* is connected to the compensation source electrode 136*c* and the light emission control source electrode 136*f*.

The storage capacitor Cst includes a first storage electrode 155*a* and a second storage electrode 156 with a second gate insulating layer 142 interposed therebetween. The first storage electrode 155*a* corresponds to the driving gate electrode 155*a*, and the second storage electrode 156 has the portion that extends from the storage line 157 that has a wider area than the driving gate electrode 155*a* and covers the entire driving gate electrode 155*a*.

Here, the second gate insulating layer 142 is the dielectric material, and the storage capacitance is determined by the charge charged in the storage capacitor Cst and the voltage between the two capacitive plates 155*a* and 156. As such, the driving gate electrode 155*a* is used as the first storage electrode 155*a*, and as a result, it is possible to ensure a space for forming the storage capacitor within a space narrowed by the driving channel 131*a* having a large area in the pixel.

The first storage electrode 155*a* which is the driving gate electrode 155*a* is connected with one end of the first driving connection member 174 through the driving contact hole 61 and a storage opening 51. The storage opening 51 is an opening formed in the second storage electrode 156. Accordingly, the contact hole 61 connecting one end of the first data connecting member 174 and the driving gate electrode 155*a* is formed inside the storage opening 51. The first data connecting member 174 is formed to be parallel to and at the same layer as the data line 171, and the other end of the first data connecting member 174 is connected to the compensation drain electrode 137*c* of the compensation transistor T3 and the initialization drain electrode 137*d* of the initialization transistor T4 through the contact hole 63. Accordingly, the first data connecting member 174 connects the driving gate electrode 155*a*, and the compensation drain electrode 137*c* of the compensation transistor T3, and initialization drain electrode 137*d* of the initialization transistor T4 to each other.

The second storage electrode 156 is connected with the driving voltage line 172 through a contact hole 69.

Accordingly, the storage capacitor Cst stores a storage capacitance corresponding to a difference between the driving voltage ELVDD transferred to the second storage electrode 156 through the driving voltage line 172 and the gate voltage Vg of the driving gate electrode 155*a*.

The third data connection member 179 is connected with the pixel electrode 191 through a contact hole 81 and the second data connection member 175 is connected with the initialization voltage line 192 through a contact hole 82.

Figure 9:
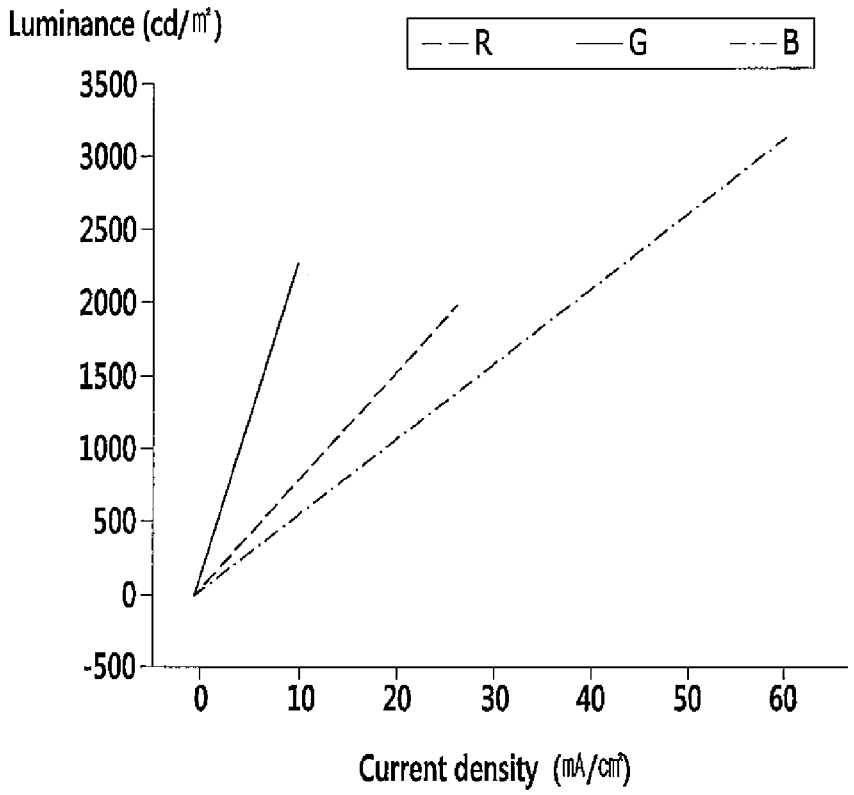
FIG. 9 is a graph showing luminance varying as a function of current density of a red pixel, a green pixel, and a blue pixel of an organic light emitting diode display according to an exemplary embodiment of the present disclosure.

FIG. 9 is a graph showing a luminance depending on a current density of a red pixel, a green pixel, and a blue pixel of an organic light emitting diode display according to an exemplary embodiment of the present disclosure.

As shown in FIG. 9, for a current-luminance ratio as a luminance depending on a current, the green pixel G is highest, the red pixel R is next, and the blue pixel B is lowest.

However, as shown in FIG. 4, the width WR of a driving channel 131*a*R of the red pixel R is larger than the width WG of a driving channel 131 aG of the green pixel G and is smaller than the width WB of a driving channel 131*a*B of the blue pixel B. Accordingly, the driving range of the driving transistor T1G of the green pixel G is larger than the driving range of the driving transistor T1R of the red pixel R, and the driving range of the driving transistor T1R of the red pixel R is larger than the driving range of the driving transistor T1B of the blue pixel B. For example, the driving range of the driving transistor T1G of the green pixel G may be controlled as 3 V, the driving range of the driving transistor T1R of the red pixel R may be controlled as 2.4 V, and the driving range of the driving transistor T1B of the blue pixel B may be controlled as 2 V. As the driving range of the driving transistor T1 is increased, the luminance depending on the current becomes less sensitive (e.g., insensitive) such that the color variation may be minimized or reduced in the pixel in which the luminance depending on the current is sensitive. That is, by forming the driving range of the driving transistor T1G of the green pixel G in which the current-luminance ratio is largest to be larger than the driving range of the driving transistor T1R of the red pixel R in which current-luminance ratio is in the middle (e.g., between the largest and the smallest current-luminance ratios), and by forming the driving range of the driving transistor T1B of the blue pixel B in which the current-luminance ratio is smallest to be smaller than the driving range of the driving transistor T1R of the red pixel R, the luminance depending on the current may become less sensitive (e.g., insensitive) in the pixel in which the luminance depending on the current is most sensitive, and the luminance depending on the current may become sensitive in the pixel in which the luminance depending on the current is the least sensitive (e.g., most insensitive).

Accordingly, the color variation between the pixels may be minimized, thereby improving the significant color variation in the low gray levels.

Hereinafter, cross-sectional structures of the pixel unit and the peripheral unit in the organic light emitting diode display device according to the exemplary embodiment of the present disclosure will be described in detail according to a lamination order with reference to FIG. 5, FIG. 6, FIG. 7, and FIG. 8.

In this case, since a lamination structure of the operation control transistor T5 is mostly the same as that of the light emission control transistor T6, a detailed description thereof may be omitted.

A buffer layer 120 may be formed on a substrate 110. The substrate 110 may be formed of an insulating material such as glass, crystal, ceramic, and/or plastic, and the buffer layer 120 blocks impurities from the substrate 110 during a crystallization process for forming a polycrystalline semiconductor to serve to improve characteristics of the polycrystalline semiconductor and reduce stress applied to the substrate 110.

The semiconductor 130 including the channel 131 including the driving channel 131*a*, the switching channel 131*b*, the compensation channel 131*c*, the initialization channel 131*d*, the operation control channel 131*e*, the light emission control channel 131*f*, and the bypass channel 131*g* is formed on the buffer layer 120. A driving source electrode 136*a* and a driving drain electrode 137*a* are formed on respective sides of the driving channel 131*a* in the semiconductor 130, and a switching source electrode 136*b* and a switching drain electrode 137*b* are formed on respective sides of the switching channel 131*b*. The compensation source electrode 136*c* and the compensation drain electrode 137*c* are formed at respective sides of the compensation channel 131*c*, and the initialization source electrode 136*d* and the initialization drain electrode 137*d* are formed at respective sides of the initialization channel 131*d*. The operation control source electrode 136*e* and the operation control drain electrode 137*e* are formed at respective sides of the operation control channel 131*e*, and the emission control source electrode 136*f* and the emission control drain electrode 137*f* are formed at respective sides of the emission control channel 1311. The bypass source electrode 136*g* and the bypass drain electrode 137*g* are formed at respective sides of the bypass channel 131*g*.

The driving channel 131*a* includes the driving channel 131*a*R of the red pixel R, the driving channel 131*a*G of the green pixel G, and the driving channel 131*a*B of the blue pixel B. In this case, the width WR of the driving channel 131*a*R of the red pixel R is greater than the width WG of the driving channel 131*a*G of the green pixel G, and the width WR of the driving channel 131*a*R of the red pixel R is less than the width WB of the driving channel 131*a*B of the blue pixel B.

A first insulating layer 141 covering the semiconductor 130 is formed thereon. On the first gate insulating layer 141, first gate wires 151, 152, 153, 158, 155*a*, 155*b*, 155*c*, 155*d*, 155*e*, and 155*f* including a switching gate electrode 155*b*, a scan line 151 including a compensating gate electrode 155*c*, a previous scan line 152 including an initialization gate electrode 155*d*, a light emission control line 153 including an operation control gate electrode 155*e* and a light emission control gate electrode 155*f*, and a bypass control line 158 including a bypass gate electrode 155*g* and a driving gate electrode (a first storage electrode) 155*a*.

A second gate insulating layer 142 covering the first gate wires 151, 152, 153, 158, 155*a*, 155*b*, 155*c*, 155*d*, 155*e*, and 155*f* and the first gate insulating layer 141 is formed thereon. The first gate insulating layer 141 and the second gate insulating layer 142 may be formed of a silicon nitride (SiNx) or a silicon oxide (SiOx).

Second gate wires 157 and 156 including a storage line 157 parallel to the scan line 151 and a second storage electrode 156 as a portion extending from the storage line 157 are formed on the second gate insulating layer 142.

The second storage electrode 156 is wider than the first storage electrode 155*a* functioning as the driving gate electrode such that the second storage electrode 156 covers the entire driving gate electrode 155*a*.

An interlayer insulating layer 160 is formed on the second gate insulating layer 142 and the second gate wires 157 and 156. The interlayer insulating layer 160 may be formed of a silicon nitride (SiNx) or a silicon oxide (SiOx).

The interlayer insulating layer 160 has contact holes 61, 62, 63, 64, 65, 66, and 69. Data wires 171, 172, 174, 175, and 179 including a data line 171, a driving voltage line 172, a driving connecting member 174, an initialization connecting member 175, and a light emission control connecting member 179 are formed on the interlayer insulating layer 160.

The data line 171 is connected to the switching source electrode 136*b* through the contact hole 62 formed in the first gate insulating layer 141, the second gate insulating layer 142, and the interlayer insulating layer 160, one end of the first data connecting member 174 is connected to the first storage electrode 155*a* through the contact hole 61 formed in the second gate insulating layer 142 and the interlayer insulating layer 160, and the other end of the first data connecting member 174 is connected to the second compensation drain electrode 137*c* and the second initialization drain electrode 137*d* through the contact hole 63 formed in the first gate insulating layer 141, the second gate insulating layer 142, and the interlayer insulating layer 160.

The second data connecting member 175 parallel to the data line 171 is connected to the initialization source electrode 136*d* through the contact hole 64 formed in the first gate insulating layer 141, the second gate insulating layer 142, and the interlayer insulating layer 160. In addition, the third data connection member 179 is connected with the light emission control drain electrode 137*f* through the contact hole 66 formed in the first gate insulating layer 141, the second gate insulating layer 142, and the interlayer insulating layer 160.

A passivation layer 180 covering the data wires 171, 172, 174, 175, and 179, and the interlayer insulating layer 160 are formed thereon. The passivation layer 180 may be formed by an organic layer.

The pixel electrode 191 and the initialization voltage line 192 are formed on the passivation layer 180. The third data connection member 179 is connected with the pixel electrode 191 through a contact hole 81 formed on the passivation layer 180, and the second data connection member 175 is connected with the initialization voltage line 192 through a contact hole 82 formed in the passivation layer 180.

A pixel definition layer (PDL) 350 covering the passivation layer 180, the initialization voltage line 192, and the pixel electrode 191 is formed on edges of the passivation layer 180, the initialization voltage line 192, and the pixel electrode 191, and the pixel definition layer 350 has a pixel opening 351 that exposes the pixel electrode 191. The pixel definition layer 350 may be made of resins such as a polyacrylate resin and a polyimide resin, and/or silica-series inorganic materials.

An organic emission layer 370 is formed on the pixel electrode 191 exposed by the pixel opening 351, and a common electrode 270 is formed on the organic emission layer 370. The common electrode 270 is formed on the pixel definition layer 350 to be formed through the plurality of pixels. As such, an organic light emitting diode OLD is formed, which includes the pixel electrode 191, the organic emission layer 370, and the common electrode 270.

The pixel electrode 191 is an anode which is a hole injection electrode and the common electrode 270 is a cathode which is an electron injection electrode. However, the exemplary embodiment according to the present disclosure is not necessarily limited thereto, and the pixel electrode 191 may be the cathode and the common electrode 270 may be the anode according to a driving method of the organic light emitting diode display. When holes and electrons are injected into the organic emission layer 370 from the pixel electrode 191 and the common electrode 270, respectively, and excitons generated through the combination of the injected holes and electrons fall from an excited state to a ground state, and light is emitted.

The organic emission layer 370 is made of a low-molecular organic material or a high-molecular organic material such as poly(3,4-ethylenedioxythiophene) (PEDOT). Further, the organic emission layer 370 may be formed by multiple layers including at least one of an emission layer, a hole injection layer (HIL), a hole transporting layer (HTL), an electron transporting layer (ETL), and an electron injection layer (EIL). When the organic emission layer 370 includes all of the layers, the hole injection layer is arranged on the pixel electrode 191 which is the positive electrode, and the hole transporting layer, the emission layer, the electron transporting layer, and the electron injection layer are sequentially laminated thereon.

The organic emission layer 370 may include a red organic emission layer emitting red light, a green organic emission layer emitting green light, and a blue organic emission layer emitting blue light, and the red organic emission layer, the green organic emission layer, and the blue organic emission layer are formed at a red pixel, a green pixel, and a blue pixel, respectively, to implement color images.

Further, in the organic emission layer 370, all of the red organic emission layer, the green organic emission layer, and the blue organic emission layer are laminated together on the red pixel, the green pixel, and the blue pixel, and a red color filter, a green color filter, and a blue color filter are formed, respectively, for each pixel to implement the color images. According to another example, a white organic emission layer emitting white light is formed on all of the red pixel, the green pixel, and the blue pixel, and the red color filter, the green color filter, and the blue color filter are formed, respectively, for each pixel to implement the color images. When the color images are implemented by using the white organic emission layer and the color filters, a deposition mask for depositing the red organic emission layer, the green organic emission layer, and the blue organic emission layer on individual pixels, that is, the red pixel, the green pixel, and the blue pixel, respectively, may not be used.

The white organic emission layer described according to another example may be formed by one organic emission layer, and includes a configuration that may emit white light by laminating a plurality of organic emission layers. For example, the white organic emission layer may include a configuration that enables the white light to be emitted by combining at least one yellow organic emission layer and at least one blue organic emission layer, a configuration that enables the white light to be emitted by combining at least one cyan organic emission layer and at least one red organic emission layer, a configuration that enables the white light to be emitted by combining at least one magenta organic emission layer and at least one green organic emission layer, and/or the like.

An encapsulation member for protecting the organic light emitting diode OLD may be formed on the common electrode 270, and the encapsulation member may be sealed to the substrate 110 by a sealant and may be formed of various materials such as glass, quartz, ceramic, plastic, and/or a metal. On the other hand, a thin film encapsulation layer may be formed on the common electrode 270 by depositing the inorganic layer and the organic layer with the sealant.

In some exemplary embodiments, the width of the driving channel in each pixel is controlled to control the driving range of each pixel, however the length of the driving channel of each pixel may be controlled to control the driving range of each pixel in other exemplary embodiments. In some exemplary embodiments, both the length and the width may be controlled.

Next, the organic light emitting diode display according to another exemplary embodiment of the present disclosure will be described with reference to FIG. 10.

Figure 10:
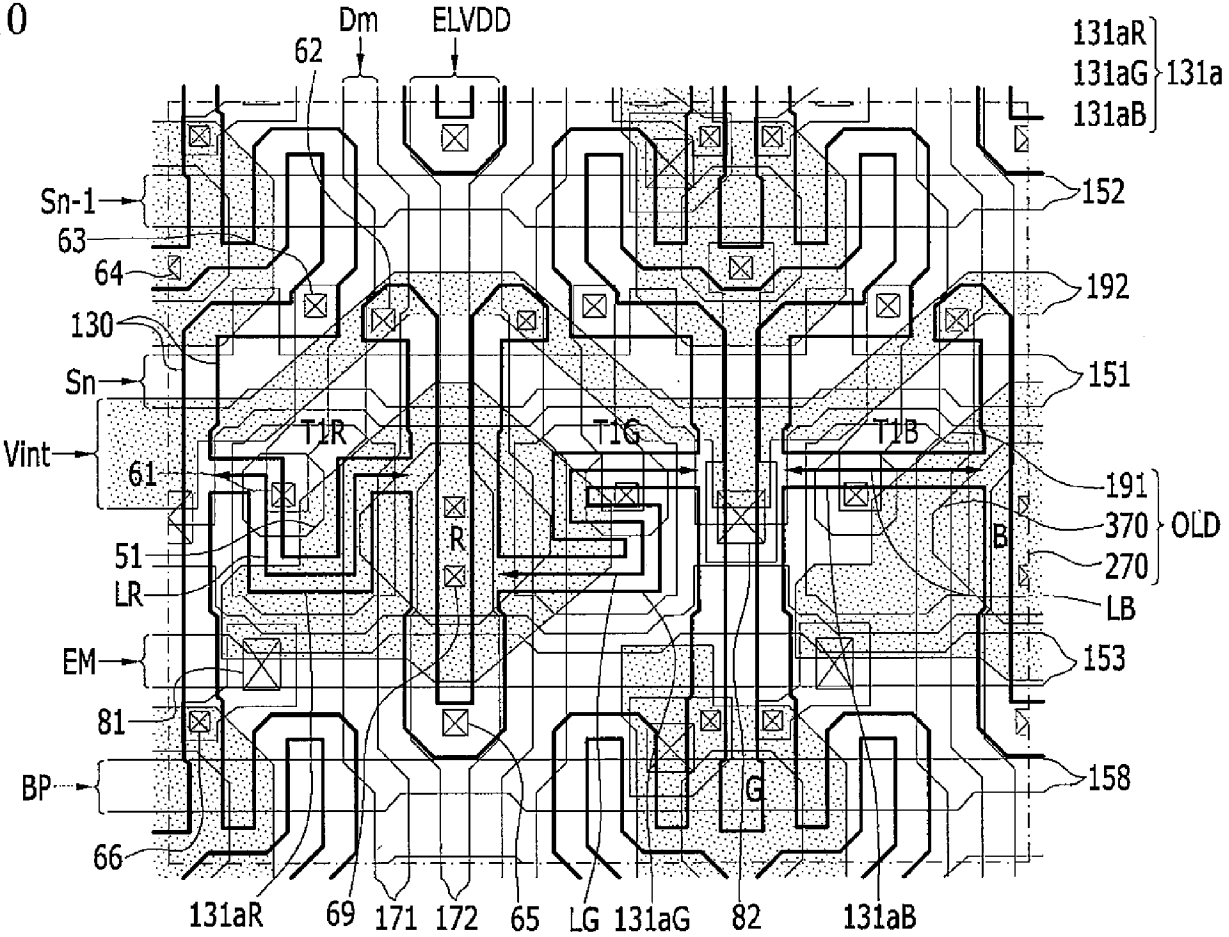
FIG. 10 is a layout view of a transistor and a capacitor forming a red pixel, a green pixel, and a blue pixel of an organic light emitting diode display according to an exemplary embodiment of the present disclosure.

FIG. 10 is a layout view of a transistor and a capacitor forming a red pixel, a green pixel, and a blue pixel of an organic light emitting diode display according to an exemplary embodiment of the present disclosure.

The exemplary embodiment shown in FIG. 10 is substantially the same as the exemplary embodiment shown in FIG. 3, FIG. 4, FIG. 5, FIG. 6, FIG. 7, and FIG. 8 except for different lengths of the driving channel of each pixel.

As shown in FIG. 10, in the organic light emitting diode display according to the exemplary embodiment of the present disclosure, the length LR of the driving channel 131*a*R of the red pixel R is shorter than the length LG of the driving channel 131*a*G of the green pixel G, and the length LR of the driving channel 131*a*R of the red pixel R is longer than the length LB of the driving channel 131 aB of the blue pixel B. Accordingly, the driving range of the driving transistor T1G of the green pixel G is greater than the driving range of the driving transistor T1R of the red pixel R, and the driving range of the driving transistor T1R of the red pixel R is greater than the driving range of the driving transistor T1B of the blue pixel B. As described above, by forming the driving range of the driving transistor T1G of the green pixel G in which the current-luminance ratio is the largest to be greater than the driving range of the driving transistor T1R of the red pixel R in which current-luminance ratio is in the middle (e.g., between the largest and the smallest current-luminance ratios), and by forming the driving range of the driving transistor T1B of the blue pixel B in which the current-luminance ratio is smallest to be less than the driving range of the driving transistor T1R of the red pixel R, the luminance depending on the current may become less sensitive (e.g., insensitive) in the pixel in which the luminance depending on the current is most sensitive, and the luminance depending on the current may become sensitive in the pixel in which the luminance depending on the current is the least sensitive (e.g., most insensitive). Accordingly, the color variation between the pixels may be minimized or reduced, thereby improving the significant color variations in the low gray levels.

Meanwhile, in some exemplary embodiments, the width of the driving channel in each pixel is controlled to control the driving range of each pixel, however the thickness of the first gate insulating layer of each pixel may be controlled to control the driving range of each pixel according to other exemplary embodiments. In some exemplary embodiments, both the length and the width may be controlled.

Next, the organic light emitting diode display according to another exemplary embodiment of the present disclosure will be described with reference to FIG. 11 and FIG. 12.

Figure 11:
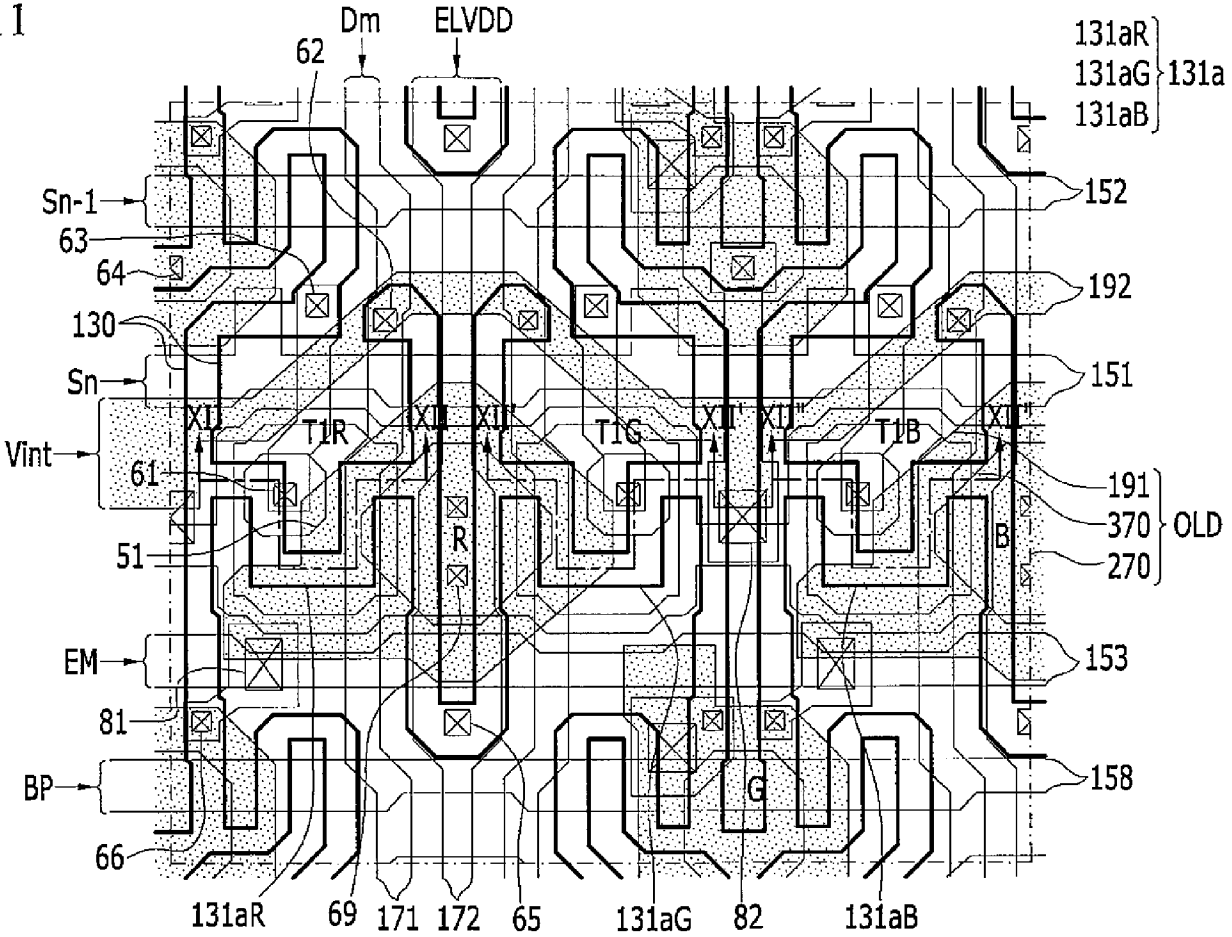
FIG. 11 is a layout view of a transistor and a capacitor forming a red pixel, a green pixel, and a blue pixel of an organic light emitting diode display according to an exemplary embodiment of the present disclosure.
Figure 12:
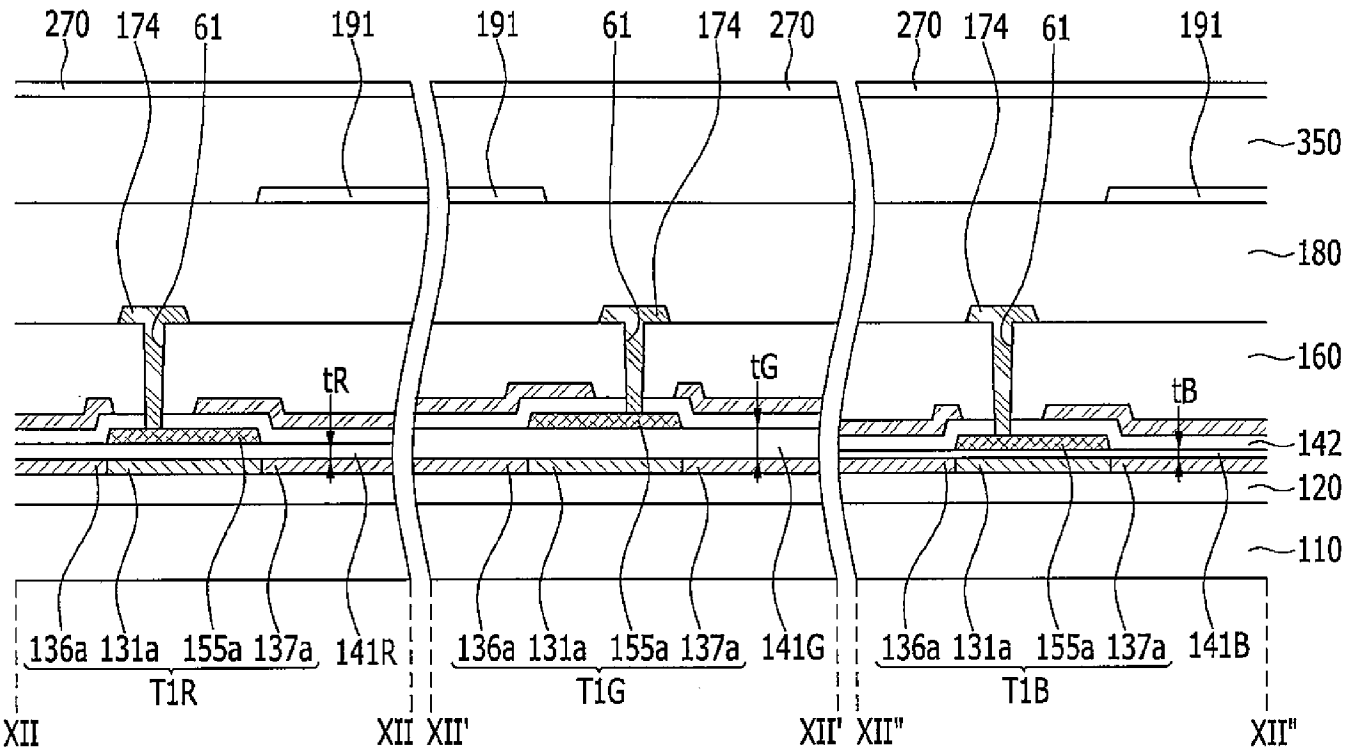
FIG. 12 is a cross-sectional view of the organic light emitting diode display of FIG. 11 taken along the lines XII-XII, XII'-XII', and XII"-XII".

FIG. 11 is a layout view of a transistor and a capacitor forming a red pixel, a green pixel, and a blue pixel of an organic light emitting diode display according to an exemplary embodiment of the present disclosure, and FIG. 12 is a cross-sectional view of the organic light emitting diode display of FIG. 11 taken along the lines XII-XII, XII'-XII', and XII"-XII".

The exemplary embodiment shown in FIG. 11 and FIG. 12 is substantially the same as the exemplary embodiments shown in FIG. 3, FIG. 4, FIG. 5, FIG. 6, FIG. 7, and FIG. 8 except for different thicknesses of the first gate insulating layer of each pixel.

As shown in FIG. 11 and FIG. 12, in the organic light emitting diode display according to the exemplary embodiment of the present disclosure, the thickness tR of a first gate insulating layer 141R of the red pixel R is shorter than the thickness tG of a first gate insulating layer 141G of the green pixel G, and the thickness tR of the first gate insulating layer 141R of the red pixel R is longer than the thickness tB of a first gate insulating layer 141B of the blue pixel B. Accordingly, the driving range of the driving transistor T1G of the green pixel G is larger than the driving range of the driving transistor T1R of the red pixel R, and the driving range of the driving transistor T1R of the red pixel R is larger than the driving range of the driving transistor T1B of the blue pixel B. As described above, by forming the driving range of the driving transistor T1G of the green pixel G in which the current-luminance ratio is the largest to be greater than the driving range of the driving transistor T1R of the red pixel R in which current-luminance ratio is in the middle (e.g., between the largest and the smallest current-luminance ratio), and by forming the driving range of the driving transistor T1B of the blue pixel B in which the current-luminance ratio is the smallest to be less than the driving range of the driving transistor T1R of the red pixel R, the color variation between the pixels may be minimized or reduced, thereby improving the color variations, which may be significant in the low gray levels.

In the exemplary embodiment shown in FIG. 11 and FIG. 12, the thickness of the first gate insulating layer of each pixel is controlled to control the driving range of the pixel, however a channel doping degree of the driving channel of each pixel may be controlled to control the driving range of each pixel according another exemplary embodiment.

Next, the organic light emitting diode display according to another exemplary embodiment of the present disclosure will be described with reference to FIG. 13.

Figure 13:
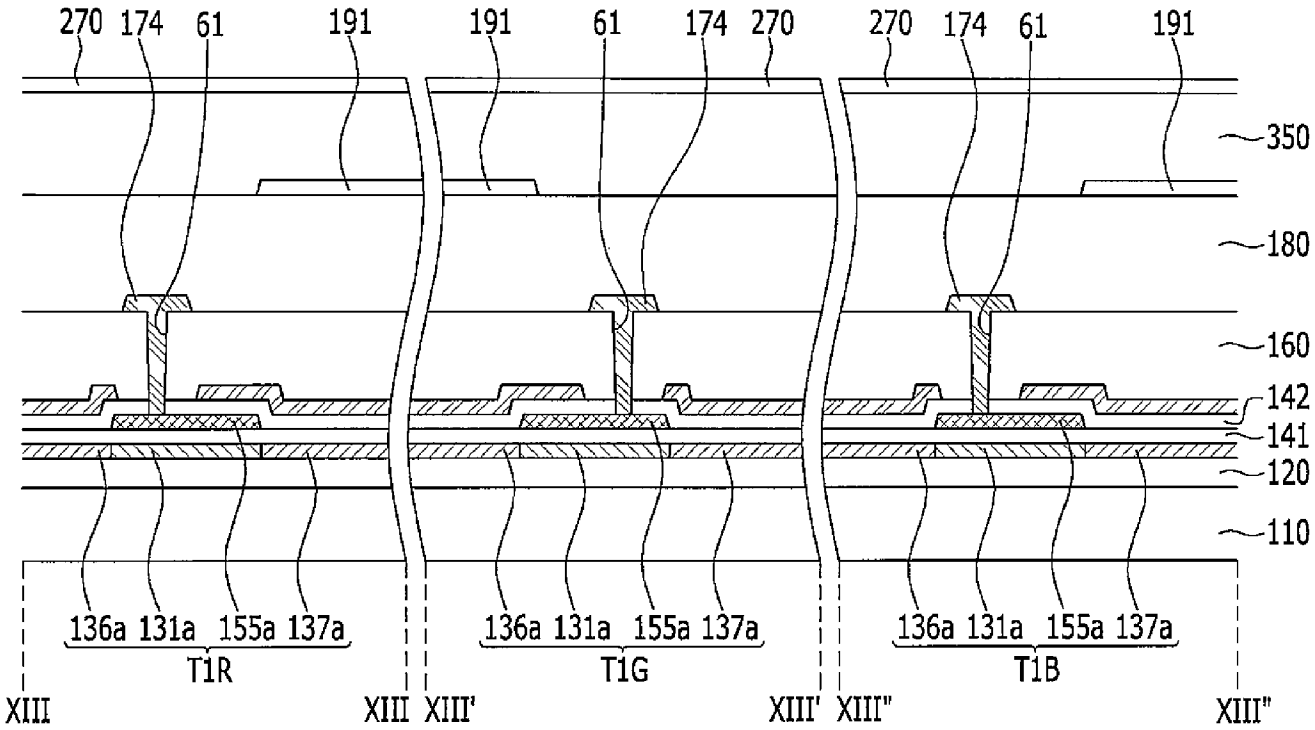
FIG. 13 is a cross-sectional view of a driving transistor of a red pixel, a green pixel, and a blue pixel of an organic light emitting diode display according to another exemplary embodiment of the present disclosure, as the organic light emitting diode display of FIG. 11 taken along the lines XII-XII, XII'-XII', and XII"-XII".

FIG. 13 is a cross-sectional view of a driving transistor of a red pixel, green pixel, and a blue pixel of an organic light emitting diode display according to another exemplary embodiment of the present disclosure, as the organic light emitting diode display of FIG. 11 taken along the lines XII-XII, XII'-XII', and XII"-XII".

The exemplary embodiment shown in FIG. 13 is substantially the same as an exemplary embodiment shown in FIG. 11 and FIG. 12 except for different doping degrees of the driving channel of each pixel.

As shown in FIG. 13, in the organic light emitting diode display according to the exemplary embodiment of the present disclosure, the channel doping degree of the driving channel 131*a*R of the red pixel R is greater than the channel doping degree of the driving channel 131*a*G of the green pixel G, and the channel doping degree of the driving channel 131*a*R of the red pixel R is less than the channel doping degree of the driving channel 131*a*B of the blue pixel B. Accordingly, the driving range of the driving transistor T1G of the green pixel G is greater than the driving range of the driving transistor T1R of the red pixel R, and the driving range of the driving transistor T1R of the red pixel R is greater than the driving range of the driving transistor T1B of the blue pixel B. As described above, by forming the driving range of the driving transistor T1G of the green pixel G in which the current-luminance ratio is the largest to be greater than the driving range of the driving transistor T1R of the red pixel R in which current-luminance ratio is in the middle (e.g., between the largest and the smallest current-luminance ratios), and by forming the driving range of the driving transistor T1B of the blue pixel B in which the current-luminance ratio is the smallest to be less than the driving range of the driving transistor T1R of the red pixel R, the color variation between the pixels may be minimized or reduced, thereby improving the significant color variations in the low gray levels.

Meanwhile, in the exemplary embodiment shown in FIG. 3, FIG. 4, FIG. 5, FIG. 6, FIG. 7, and FIG. 8, the driving ranges of all driving transistors of the red pixel, the green pixel, and the blue pixel are different, however the driving ranges of the driving transistors of two pixel may be the same or substantially the same and the driving range of the driving transistor of the remaining one pixel may be different, or the driving range of the driving transistor of any one pixel may be different from the driving ranges of the remaining two driving transistors according to another exemplary embodiment.

Next, the organic light emitting diode display according to another exemplary embodiment of the present disclosure in which the driving ranges of the driving transistors of two pixels are the same or substantially the same and the driving range of the driving transistor of one remaining pixel is different will be described with reference to FIG. 14.

Figure 14:
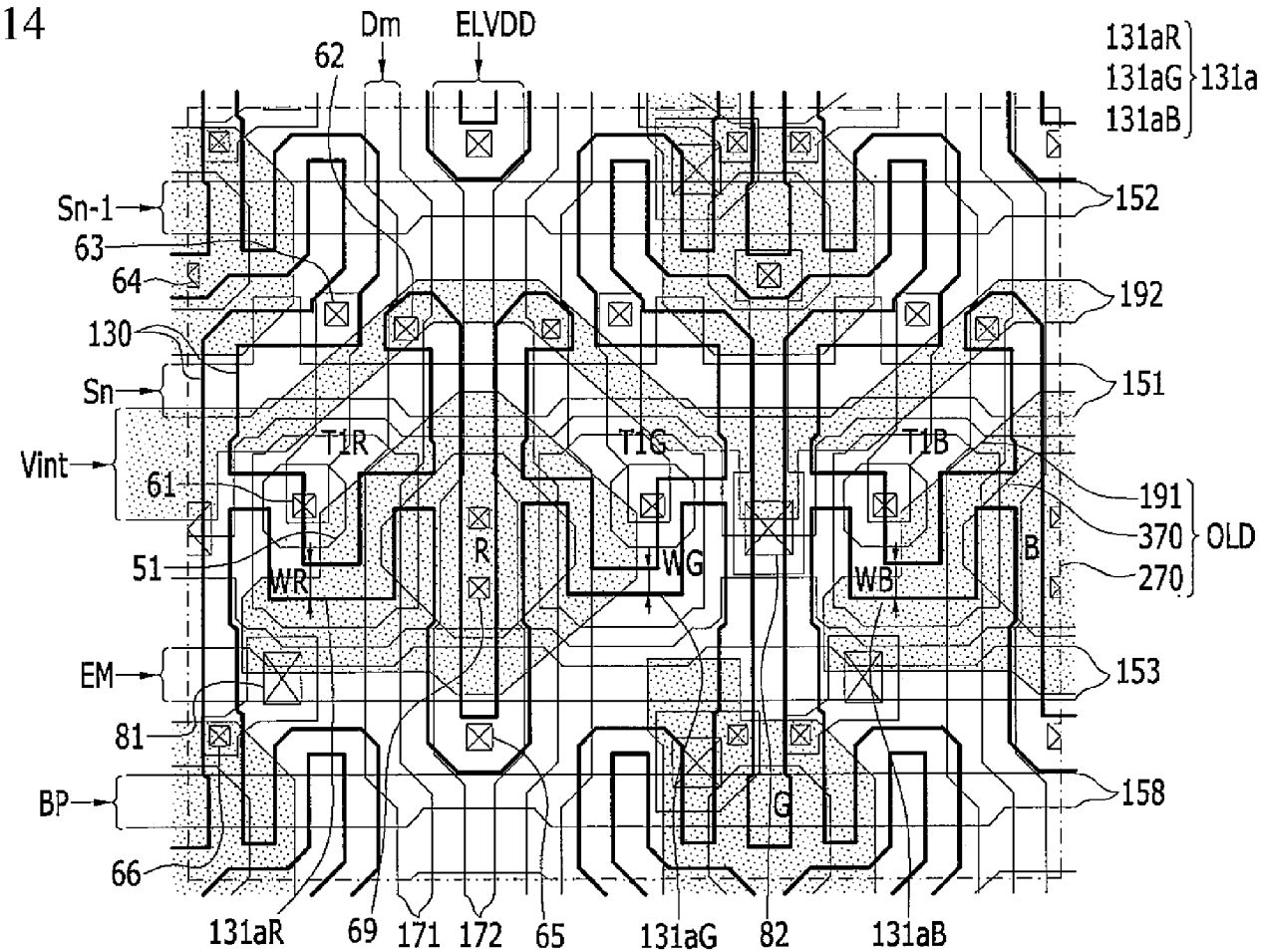
FIG. 14 is a layout view of a transistor and a capacitor forming a red pixel, a green pixel, and a blue pixel of an organic light emitting diode display according to an exemplary embodiment of the present disclosure.

FIG. 14 is a layout view of a transistor and a capacitor forming a red pixel, a green pixel, and a blue pixel of an organic light emitting diode display according to an exemplary embodiment of the present disclosure.

The exemplary embodiment shown in FIG. 14 is substantially the same as the exemplary embodiment shown in FIG. 3, FIG. 4, FIG. 5, FIG. 6, FIG. 7, and FIG. 8 except that the lengths of the driving channels of the red pixel and the blue pixel are the same or substantially the same and the length of the driving channel of the green pixel is different from them such that the repeated description thereof is omitted.

As shown in FIG. 14, in the organic light emitting diode display according to the exemplary embodiment of the present disclosure, the width WR of the driving channel 131*a*R of the red pixel R is the same or substantially the same as the width WB of the driving channel 131*a*B of the blue pixel B, and the width WG of the driving channel 131*a*G of the green pixel G is less than the width WR of the driving channel 131 aR of the red pixel R.

Accordingly, the driving range of the driving transistor T1R of the red pixel R is the same or substantially the same as the driving range of the driving transistor T1B of the blue pixel B, and the driving range of the driving transistor T1G of the green pixel G is greater than the driving range of the driving transistor T1R of the red pixel R or the driving range of the driving transistor T1B of the blue pixel B.

As described above, by forming the driving range of the driving transistor T1G of the green pixel G in which the current-luminance ratio is the largest to be greater than the driving range of the driving transistor T1R of the red pixel R or the driving range of the driving transistor T1B of the blue pixel B in which the current-luminance ratio is small, the luminance depending on the current may become less sensitive (e.g., insensitive) in the green pixel in which the luminance depending on the current is most sensitive, and the luminance depending on the current may become sensitive in the red pixel or the blue pixel in which the luminance depending on the current is less sensitive (e.g., insensitive) Accordingly, the color variation between the pixels may be minimized or reduced, thereby improving the color variations, which may be significant in the low gray levels.

While this disclosure has been described in connection with what is presently considered to be practical exemplary embodiments, it is to be understood that the disclosure is not limited to the disclosed embodiments, but, on the contrary, is intended to cover various modifications and equivalent arrangements included within the spirit and scope of the appended claims and their equivalents.

DESCRIPTION OF SOME OF THE SYMBOLS

131*a*: driving channel
132*b*: switching channel
141: first gate insulating layer
142: second gate insulating layer
151: scan line
152: previous scan line
153: light emission control line
158: bypass control line
155*a*: driving gate electrode
155*b*: switching gate electrode
156: second storage electrode
157: storage line
160: interlayer insulating layer
171: data line
172: driving voltage line
174: first data connecting member
175: second data connecting member
179: third data connecting member
180: passivation layer
191: pixel electrode
192: initialization voltage line
270: common electrode
350: pixel definition layer
370: organic emission layer
131*a*R: driving channel of red pixel
131*a*G: driving channel of green pixel
131*a*B: driving channel of blue pixel
141R: first gate insulating layer of red pixel
141G: first gate insulating layer of green pixel
141B: first gate insulating layer of blue pixel

What is claimed is:

1. An organic light emitting diode display comprising:
a substrate;
a plurality of scan lines on the substrate and configured to transmit a scan signal;
a plurality of data lines and a plurality of driving voltage lines crossing the scan lines and configured to transmit a data voltage and a driving voltage, respectively; and
a plurality of pixels comprising a red pixel, a green pixel, and a blue pixel, and connected to the plurality of scan lines and the plurality of data lines, each of the pixels comprising:
a switching transistor connected to a corresponding one of the scan lines and a corresponding one of the data lines;
a driving transistor connected to the switching transistor; and
an organic light emitting diode connected to the driving transistor,
wherein a driving range of each driving transistor of the red pixel, the green pixel, and the blue pixel is different, and is a difference between a maximum driving gate-source voltage of the driving transistor corresponding to a maximum gray level and a minimum driving gate-source voltage of the driving transistor corresponding to a minimum gray level,
wherein the driving range of the driving transistor increases as a current-luminance ratio of a corresponding pixel is increased,
wherein the current-luminance ratio of the green pixel is greater than the current-luminance ratio of the red pixel,
wherein the current-luminance ratio of the red pixel is greater than the current-luminance ratio of the blue pixel,
wherein the driving range of the driving transistor of the green pixel is greater than the driving range of the driving transistor of the red pixel, and
wherein the driving range of the driving transistor of the red pixel is greater than the driving range of the driving transistor of the blue pixel.

2. The organic light emitting diode display of claim 1, wherein the driving transistor comprises:
a driving channel on the substrate,
a driving gate electrode overlapping the driving channel, and
a driving source electrode and a driving drain electrode at respective sides of the driving channel.

3. The organic light emitting diode display of claim 2, wherein a width of the driving channel of the green pixel is less than a width of the driving channel of the red pixel, and the width of the driving channel of the red pixel is less than a width of the driving channel of the blue pixel.

4. The organic light emitting diode display of claim 2, wherein a length of the driving channel of the green pixel is larger than the length of the driving channel of the red pixel, and the length of the driving channel of the red pixel is larger than the length of the driving channel of the blue pixel.

5. The organic light emitting diode display of claim 2, further comprising a first gate insulating layer between the driving channel and the driving gate electrode,
wherein a thickness of the first gate insulating layer of the green pixel is greater than a thickness of the first gate insulating layer of the red pixel, and the thickness of the first gate insulating layer of the red pixel is greater than a thickness of the first gate insulating layer of the blue pixel.

6. The organic light emitting diode display of claim 2, wherein a channel doping degree of the driving channel of the green pixel is less than a channel doping degree of the driving channel of the red pixel, and the channel doping degree of the driving channel of the red pixel is less than a channel doping degree of the driving channel of the blue pixel.

7. The organic light emitting diode display of claim 1, wherein the organic light emitting diode comprises:

a pixel electrode electrically connected to the driving transistor;

an organic emission layer on the pixel electrode; and a common electrode on the organic emission layer.

8. An organic light emitting diode display comprising:

a substrate;

a plurality of scan lines on the substrate and configured to transmit a scan signal;

a plurality of data lines and a plurality of driving voltage lines crossing the scan lines and configured to transmit a data voltage and a driving voltage, respectively; and a plurality of pixels comprising a first pixel, a second pixel, and a third pixel, and connected to the plurality of scan lines and the plurality of data lines, wherein each of the pixels comprises:

a switching transistor connected to a corresponding one of the scan lines and a corresponding one of the data lines;

a driving transistor connected to the switching transistor; and an organic light emitting diode connected to the driving transistor, wherein a driving range of the driving transistor of at least one of the first pixel, the second pixel, and the third pixel is different from the driving range of the driving transistor of at least another one of the first pixel, the second pixel, and the third pixel, wherein the driving ranges of two driving transistors from among the first pixel, the second pixel, and the third pixel, are the same, and are different from the driving range of the driving transistor of at least another one of the first pixel, the second pixel, and the third pixel, wherein the driving range of the driving transistor is a difference between a maximum driving gate-source voltage of the driving transistor corresponding to a maximum gray level and a minimum driving gate-source voltage of the driving transistor corresponding to a minimum gray level, wherein the driving range of the driving transistor increases as a current-luminance ratio of a corresponding pixel from among the first pixel, the second pixel, and the third pixel is increased, and wherein the first pixel, the second pixel, and the third pixel are a red pixel, a green pixel, and a blue pixel, respectively, and the current-luminance ratio of the green pixel is greater than the current-luminance ratio of the red pixel, the current-luminance ratio of the red pixel is greater than the current-luminance ratio of the blue pixel, the driving range of the driving transistor of the green pixel is greater than the driving range of the driving transistor of the red pixel, and the driving range of the driving transistor of the red pixel is greater than the driving range of the driving transistor of the blue pixel.

9. An organic light emitting diode display comprising:

a substrate;

a plurality of scan lines on the substrate and configured to transmit a scan signal;

a plurality of data lines and a plurality of driving voltage lines crossing the scan lines and configured to transmit a data voltage and a driving voltage, respectively; and a plurality of pixels comprising a first pixel, a second pixel, and a third pixel, and connected to the plurality of scan lines and the plurality of data lines, wherein each of the pixels comprises:

a switching transistor connected to a corresponding one of the scan lines and a corresponding one of the data lines;

a driving transistor connected to the switching transistor; and an organic light emitting diode connected to the driving transistor, wherein a driving range of the driving transistor of at least one of the first pixel, the second pixel, and the third pixel is different from the driving range of the driving transistor of at least another one of the first pixel, the second pixel, and the third pixel, wherein the driving range of the driving transistor from among the first pixel, the second pixel, and the third pixel, is different from the driving range of the driving transistors of at least another one of the first pixel, the second pixel, and the third pixel, wherein the driving range of the driving transistor is a difference between a maximum driving gate-source voltage of the driving transistor corresponding to a maximum gray level and a minimum driving gate-source voltage of the driving transistor corresponding to a minimum gray level, wherein the driving range of the driving transistor increases as a current-luminance ratio of a corresponding pixel from among the first pixel, the second pixel, and the third pixel, is increased, and wherein the first pixel, the second pixel, and the third pixel are a red pixel, a green pixel, and a blue pixel, respectively, and the current-luminance ratio of the green pixel is greater than the current-luminance ratio of the red pixel, the current-luminance ratio of the red pixel is greater than the current-luminance ratio of the blue pixel, the driving range of the driving transistor of the green pixel is greater than the driving range of the driving transistor of the red pixel, and the driving range of the driving transistor of the red pixel is greater than the driving range of the driving transistor of the blue pixel.

* * * * *